US011248354B2

(12) United States Patent
Weihl

(10) Patent No.: US 11,248,354 B2
(45) Date of Patent: Feb. 15, 2022

(54) PLOW ASSEMBLY

(71) Applicant: Ricky A. Weihl, Muskegon, MI (US)

(72) Inventor: Ricky A. Weihl, Muskegon, MI (US)

( * ) Notice: Subject to any disclaimer, the term of this patent is extended or adjusted under 35 U.S.C. 154(b) by 0 days.

(21) Appl. No.: 17/199,041

(22) Filed: Mar. 11, 2021

(65) Prior Publication Data

US 2021/0285171 A1 Sep. 16, 2021

Related U.S. Application Data

(60) Provisional application No. 62/988,545, filed on Mar. 12, 2020.

(51) Int. Cl.
*E01H 5/06* (2006.01)

(52) U.S. Cl.
CPC ..... *E01H 5/061* (2013.01); *E01H 5/065* (2013.01); *E01H 5/067* (2013.01); *E01H 5/068* (2013.01)

(58) Field of Classification Search
CPC ..... E02F 5/02; E02F 5/027
See application file for complete search history.

(56) References Cited

U.S. PATENT DOCUMENTS 2,590,143 A * 3/1952 Adams, Jr. ..... E01H 5/06 37/273
2,731,739 A 1/1956 Miller
2,904,287 A 9/1959 Ertsgaard et al.
2,904,904 A * 9/1959 Krueger ..... E01H 5/065 37/275
3,000,224 A 9/1961 Ertsgaard et al.
3,078,603 A 2/1963 Ertsgaard et al.
3,279,104 A * 10/1966 Wandscheer ..... E01H 5/067 37/280
3,359,661 A 12/1967 Speiser et al.
3,477,151 A * 11/1969 Zanella ..... E01H 5/065 37/281
3,512,279 A 5/1970 Benson
3,512,589 A * 5/1970 Ulrich ..... E02F 3/815 172/786
4,012,175 A 3/1977 Simonds, Jr.
(Continued)

FOREIGN PATENT DOCUMENTS

| | | |
|---|---|---|
| CA | 2 600 003 | 2/2009 |
| CA | 2 570 985 | 6/2018 |
| WO | 2021/087612 | 5/2021 |

OTHER PUBLICATIONS

US 6,000,150 A, 12/1999, Depies et al. (withdrawn)
(Continued)

*Primary Examiner* — Jessica H Lutz
(74) *Attorney, Agent, or Firm* — Warner Norcross + Judd LLP

(57) ABSTRACT

A snow plow having a wing that is rotatably coupled to a side of a primary plow, and configured to rotate about a first axis substantially parallel to the side of the primary plow. A portion of the wing is operable to rotate about a second axis that is non-parallel to the first axis, where the portion is operable to rotate upward about the second axis relative to the ground in response to the wing encountering an obstruction. A snow plow having a receiver coupled to a surface of the primary plow and an actuator coupled to the receiver. The receiver allows the snow plow to move proximally and distally with respect to a vehicle.

20 Claims, 13 Drawing Sheets

(56) References Cited

U.S. PATENT DOCUMENTS 4,026,048 A 5/1977 Hill et al.
4,028,820 A 6/1977 Simonds, Jr.
4,145,825 A * 3/1979 Bertolino ..... E01H 5/065 172/113
4,187,624 A 2/1980 Blau
4,206,602 A 6/1980 Watson et al.
4,275,514 A 6/1981 Maura
4,277,818 A 7/1981 Urbanek et al.
4,300,295 A 11/1981 Heismann
4,304,056 A 12/1981 Watson et al.
4,304,057 A 12/1981 Watson et al.
4,439,939 A 4/1984 Blau
4,479,312 A * 10/1984 Turgeon ..... E01H 4/02 37/219
4,574,502 A 3/1986 Blau
4,614,048 A 9/1986 Melby
4,658,519 A * 4/1987 Quenzi ..... E01H 5/063 172/272
4,741,116 A * 5/1988 Engle ..... E01H 5/065 172/701.1
4,910,893 A * 3/1990 Asay ..... A01K 1/10 172/364
4,962,600 A 10/1990 Zellaha et al.
4,999,935 A 3/1991 Simi et al.
5,125,174 A 6/1992 Watson et al.
5,353,530 A 10/1994 Pieper
5,420,480 A 5/1995 Knepel et al.
5,524,368 A 6/1996 Struck et al.
5,638,618 A 6/1997 Niemela et al.
5,655,318 A 8/1997 Daniels
RE35,700 E 12/1997 Watson et al.
5,758,728 A * 6/1998 Ragule ..... E01H 5/065 172/815
5,806,213 A 9/1998 Doornek et al.
5,806,214 A 9/1998 Behrens et al.
5,819,444 A * 10/1998 Desmarais ..... E01H 5/065 37/281
5,829,174 A 11/1998 Hadler et al.
5,860,230 A * 1/1999 Daniels ..... E01H 5/065 37/232
5,864,783 A 1/1999 Struck et al.
5,894,688 A 4/1999 Struck et al.
5,899,007 A * 5/1999 Niemela ..... E02F 3/8155 37/281
5,903,986 A * 5/1999 Parker ..... E01H 5/066 37/281
5,987,785 A 11/1999 Aguado et al.
6,012,240 A 1/2000 Klug et al.
6,044,579 A 4/2000 Hadler et al.
6,050,008 A 4/2000 Doornek et al.
6,081,770 A 6/2000 Struck et al.
6,108,946 A 8/2000 Christy
6,134,814 A 10/2000 Christy et al.
6,154,986 A 12/2000 Hadler et al.
6,170,178 B1 1/2001 Christy
6,178,669 B1 1/2001 Quenzi et al.
6,209,235 B1 * 4/2001 Schiltz ..... E01H 5/02 37/265
6,240,660 B1 * 6/2001 Dugas ..... E01H 5/066 37/280
6,253,470 B1 7/2001 Depies et al.
6,276,076 B1 8/2001 Quenzi et al.
6,351,772 B1 2/2002 Struck et al.
6,393,737 B2 5/2002 Quenzi et al.
6,408,549 B1 * 6/2002 Quenzi ..... E01H 5/065 37/281
6,412,199 B1 * 7/2002 Quenzi ..... E01H 5/065 37/281
6,425,196 B1 7/2002 Weagley et al.
6,442,877 B1 9/2002 Quenzi et al.
6,467,199 B1 10/2002 Christy
6,526,677 B1 3/2003 Bloxdorf et al.
6,581,307 B1 * 6/2003 Jones ..... E01H 5/067 37/274
6,615,513 B2 9/2003 Quenzi et al.
6,618,965 B1 9/2003 Schultz et al.
6,643,601 B1 11/2003 Struck et al.
6,691,435 B1 2/2004 Schultz et al.
6,701,646 B2 3/2004 Schultz et al.
6,711,837 B2 3/2004 Bloxdorf et al.
6,751,894 B2 * 6/2004 Verseef ..... E01H 5/062 172/265
6,775,933 B2 8/2004 Koch et al.
6,788,932 B2 8/2004 Struck et al.
RE38,665 E 12/2004 Struck et al.
6,860,039 B2 3/2005 Schultz et al.
6,860,040 B2 3/2005 Schultz et al.
6,877,258 B2 * 4/2005 Frey ..... E01H 5/06 37/274
6,928,757 B2 8/2005 Bloxdorf et al.
6,941,685 B2 9/2005 Goy et al.
6,944,978 B2 9/2005 LeBlond et al.
7,051,819 B1 * 5/2006 Schenk ..... E01H 1/003 172/782
7,100,311 B2 * 9/2006 Verseef ..... E01H 5/066 172/815
7,134,227 B2 * 11/2006 Quenzi ..... E01H 5/066 37/274
7,137,724 B2 11/2006 Menze et al.
7,146,754 B2 12/2006 Schultz et al.
7,152,883 B2 12/2006 Niemela
7,171,769 B2 2/2007 Schultz et al.
7,171,770 B2 2/2007 Schultz et al.
7,328,529 B2 2/2008 Bergsten
7,347,014 B1 * 3/2008 Fiandach ..... E01H 5/066 172/815
7,410,281 B2 8/2008 Menze et al.
7,430,821 B2 10/2008 LeBlond et al.
7,438,458 B2 10/2008 Menze et al.
7,437,839 B2 12/2008 Christy et al.
7,481,011 B2 * 1/2009 Nesseth ..... E01H 5/066 172/815
7,493,710 B2 2/2009 Frey et al.
7,513,069 B1 4/2009 Gamble, II et al.
7,520,114 B2 4/2009 Bergsten et al.
7,520,348 B2 4/2009 Bergsten et al.
7,584,557 B1 9/2009 Nistler
7,640,682 B1 * 1/2010 Buckbee ..... E01H 5/066 37/281
7,681,334 B2 3/2010 LeBlond et al.
7,681,337 B2 * 3/2010 Watson ..... E01H 5/065 37/281
7,721,471 B2 5/2010 Gamble, II
7,730,644 B2 6/2010 Frey et al.
7,743,536 B2 * 6/2010 Evans ..... E01H 5/06 37/274
7,762,698 B2 7/2010 Menze
7,797,859 B2 9/2010 LeBlond et al.
7,805,863 B2 * 10/2010 Vennard ..... E02F 3/8157 37/266
7,836,613 B2 11/2010 Koch et al.
7,841,109 B2 11/2010 Stevens et al.
7,841,110 B2 11/2010 Koch et al.
7,918,042 B2 * 4/2011 Ropog ..... E01H 5/066 37/281
7,934,328 B2 5/2011 Gamble, II
7,959,463 B1 6/2011 Menze et al.
7,963,052 B2 6/2011 Koch et al.
7,992,327 B2 8/2011 Gamble, II et al.
8,061,063 B2 11/2011 Gamble, II
8,065,822 B2 11/2011 Maas et al.
8,068,961 B2 11/2011 Menze
8,127,471 B2 3/2012 Stevens et al.
8,127,472 B2 * 3/2012 Kotila ..... E01H 5/066 37/281
8,162,521 B2 4/2012 Menze et al.
8,185,276 B2 5/2012 Buckbee et al.
8,375,607 B2 2/2013 Menze
8,499,477 B2 8/2013 Gamble, II
8,607,482 B2 * 12/2013 Bloxdorf ..... E01H 5/065 37/274

(56) References Cited

U.S. PATENT DOCUMENTS

| | | | | |
|---|---|---|---|---|
| 8,689,897 | B2 * | 4/2014 | May | E02F 3/8152 172/777 |
| 8,793,907 | B2 | 8/2014 | Walimaa et al. | |
| 8,832,974 | B2 | 9/2014 | Koch et al. | |
| 8,850,724 | B2 * | 10/2014 | Bloxdorf | E01H 5/067 37/283 |
| 8,935,862 | B1 | 1/2015 | Koch et al. | |
| 8,978,276 | B2 | 3/2015 | Moon, Jr. et al. | |
| 9,051,700 | B2 | 6/2015 | Summers et al. | |
| 9,194,091 | B2 | 11/2015 | Moon, Jr. et al. | |
| 9,200,418 | B2 | 12/2015 | Jones et al. | |
| 9,303,385 | B2 | 4/2016 | Whipple | |
| 9,315,958 | B2 | 4/2016 | Walimaa et al. | |
| 9,822,563 | B2 | 11/2017 | Jones et al. | |
| 9,869,067 | B2 | 1/2018 | Barker et al. | |
| 10,053,826 | B1 * | 8/2018 | Null | E01H 5/061 |
| 10,132,050 | B1 * | 11/2018 | Mandan | E02F 3/3414 |
| 10,472,783 | B2 | 11/2019 | Rich | |
| 10,480,140 | B2 | 11/2019 | Vigneault | |
| 10,538,194 | B2 | 1/2020 | Koch et al. | |
| D880,027 | S | 3/2020 | Horn et al. | |
| 10,870,959 | B1 * | 12/2020 | Gass | E01H 5/063 |
| 2004/0006895 | A1 | 1/2004 | Schultz et al. | |
| 2004/0172858 | A1 | 9/2004 | Bloxdorf et al. | |
| 2005/0120595 | A1 | 6/2005 | Bloxdorf et al. | |
| 2006/0005434 | A1 | 1/2006 | Goy et al. | |
| 2006/0005435 | A1 | 1/2006 | Gamble, II et al. | |
| 2007/0068049 | A1 | 3/2007 | Quenzi et al. | |
| 2007/0089327 | A1 * | 4/2007 | Watson | E01H 5/065 37/281 |
| 2009/0282706 | A1 * | 11/2009 | Barker | E01H 5/061 37/196 |
| 2009/0307942 | A1 | 12/2009 | Gamble, II et al. | |
| 2009/0307943 | A1 * | 12/2009 | Buckbee | E01H 5/066 37/266 |
| 2012/0279093 | A1 | 11/2012 | Niemela et al. | |
| 2012/0311893 | A1 * | 12/2012 | Knott | E01H 5/066 37/233 |
| 2013/0263480 | A1 | 10/2013 | Stevens et al. | |
| 2015/0252543 | A1 | 9/2015 | Andie | |
| 2017/0218597 | A1 | 8/2017 | Holman | |
| 2017/0298583 | A1 | 10/2017 | Budrow et al. | |
| 2019/0323204 | A1 * | 10/2019 | Vigneault | E01H 5/063 |
| 2020/0018030 | A1 | 1/2020 | Vigneault | |
| 2020/0032469 | A1 | 1/2020 | Rich | |
| 2020/0070713 | A1 | 3/2020 | Koch et al. | |
| 2020/0071894 | A1 | 3/2020 | Coyne et al. | |
| 2020/0114803 | A1 | 4/2020 | Horn | |

OTHER PUBLICATIONS

Youtube, "Directional Control Valve Basics, Part 1", video capture on Feb. 28, 2020, downloaded at youtube.com/watch?v=CQPwvWXbV3w&feature=youtu.be, pp. 1-15.

Realtruck, "HowTo Install a Snow Plow on Your Truck", downloaded at https://realtruck/com/blog/how-to-install-a-snow-plow-on-your-truck on Feb. 16, 2021, pp. 1-10.

Metal Pless 2019 Catalog downloaded at http://mndot.org/maintenance/equipment/contracts/T-632(5)tractor_attach/2020/Lano/gmetalplesscomb.pdf, pp. 1-31.

Metal Pless Presentation video available at https://www.youtube com/watch?v=ZztAqZxLkvA, uploaded Aug. 28, 2018.

* cited by examiner

PLOW ASSEMBLY

TECHNICAL FIELD

The present application relates to a plow for a vehicle, and more particularly to a plow with a movable wing and a plow movable with respect to a vehicle.

BACKGROUND

There are a variety of conventional plow constructions for vehicles. One type of conventional plow configuration is a back-blade style of plow having a main snow plow blade and wings attached to a side edge of the main snow plow blade. The back-blade style of plow may be mounted to a rear of a plow vehicle, and may include conventional wings that provide a larger plow face in use while being stowable for travel on the road. Another type of plow is a front-blade plow, where the plow may be mounted to the front of a plow vehicle. The front-blade plow may also include conventional wings like the back-blade plow.

In conventional plows with wings, the wings may be rotated in a limited manner about a single axis defined by the side edge of the main snow plow blade, where the wing is limited to rotation from a stowed position proximal to the sides of the plow vehicle to a position parallel to the main snow plow blade. This configuration, as mentioned above, allows a plow operator to position the wings proximal to the sides of the plow vehicle in order to operate the vehicle on a municipal road and within the lane constraints of the municipal road. Conventionally, once the vehicle arrives at the site to be plowed, the operator actuates the wings of the plow to a position parallel to the main snow plow blade or a fully extended position, forming a plow face or plow area that is greater than would otherwise be possible without failing to comply with the lane constraints of a municipal road.

In practice, the conventional plow with the wings in the fully extended position is likely to encounter an obstruction at least once during the operational life of the plow. Driveways and parking lots can include obstructions that are concealed by snow that the plow operator cannot see. As a result, the conventional plow may include control arms and springs coupled between the plow vehicle mount and the plow that allow the plow to tilt in response to encountering an obstruction. This tilting action can prevent damage to the plow in response to encountering the obstruction; however, the plow control arms and springs are limited in degree of titling action provided to a single axis

SUMMARY OF THE DESCRIPTION

The present disclosure is directed to a snow plow having a wing that is rotatably coupled to a side of a primary plow, and configured to rotate about a first axis substantially parallel to the side of the primary plow. A portion of the wing is operable to rotate about a second axis that is non-parallel to the first axis, where the portion is operable to rotate upward about the second axis relative to the ground in response to the wing encountering an obstruction.

In one embodiment, the snow plow includes a primary plow and a first wing. The primary plow may include first and second sides opposite each other with a blade disposed between the first and second sides. The blade may be operable to contact a ground surface to facilitate moving snow.

In one embodiment, the first wing is rotatably coupled to the first side of the primary plow via a first connection, and configured to rotate about a first axis substantially parallel to the first side of the primary plow. The first wing may include a main wing portion operable to rotate about a second axis that is non-parallel to the first axis, where the main wing portion is operable to rotate upward about the second axis relative to the ground in response to the first wing encountering an obstruction.

In one embodiment, the first wing may include a secondary portion operably coupled to the first side of the primary plow via the first connection. The secondary portion may be connected to the main wing portion via a lower connector and an upper connector. The lower connector may include a pivotable connection to the secondary portion and a fixed connection to the main wing portion, thereby enabling the main wing portion to rotate about the pivotable connection, wherein the pivotable connection defines the second axis.

In one embodiment, the upper connector includes first and second springs that oppose each other in compression, where a position of equilibrium between the first and second springs corresponds to a primary operating position of the first wing relative to the primary plow, wherein the first spring enables upward rotation of the main wing portion in response to the first wing encountering an obstruction that exerts an upward force on the main wing portion.

In one embodiment, the upper connector includes a hydraulic actuator operable to rotate the main wing portion upward and downward about the second axis in response to respective retraction and extension of the hydraulic actuator.

In one embodiment, the hydraulic actuator is operably coupled to an adjustable relief valve configured to enable the hydraulic actuator to retract in response to application of force on the main wing portion in a direction perpendicular to the second axis and greater than a threshold trip force.

In one embodiment, a first wing blade is rotatably coupled to the first wing such that the first wing blade is able to rotate upward in response to the first wing blade encountering an obstruction that exerts a sufficient force on the first wing blade (e.g., a force greater than a threshold force).

In one embodiment, a hydraulic actuator is operably coupled to the first wing blade to control the wing and enable it to rotate upward in response to encountering an obstruction or in response to a command from an operator.

The present disclosure is also directed to a receiver that movably couples the snow plow to the mounting device attached to the plow vehicle. In one embodiment, the receiver may be coupled to at least one hydraulic actuator and movably coupled to a receiver interface extending from the surface of the snow plow. As the hydraulic actuator(s) move the receiver interface in and out of the receiver, the distance proximally and distally between the snow plow and the plow vehicle changes.

These and other advantages and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION

Figure 1:
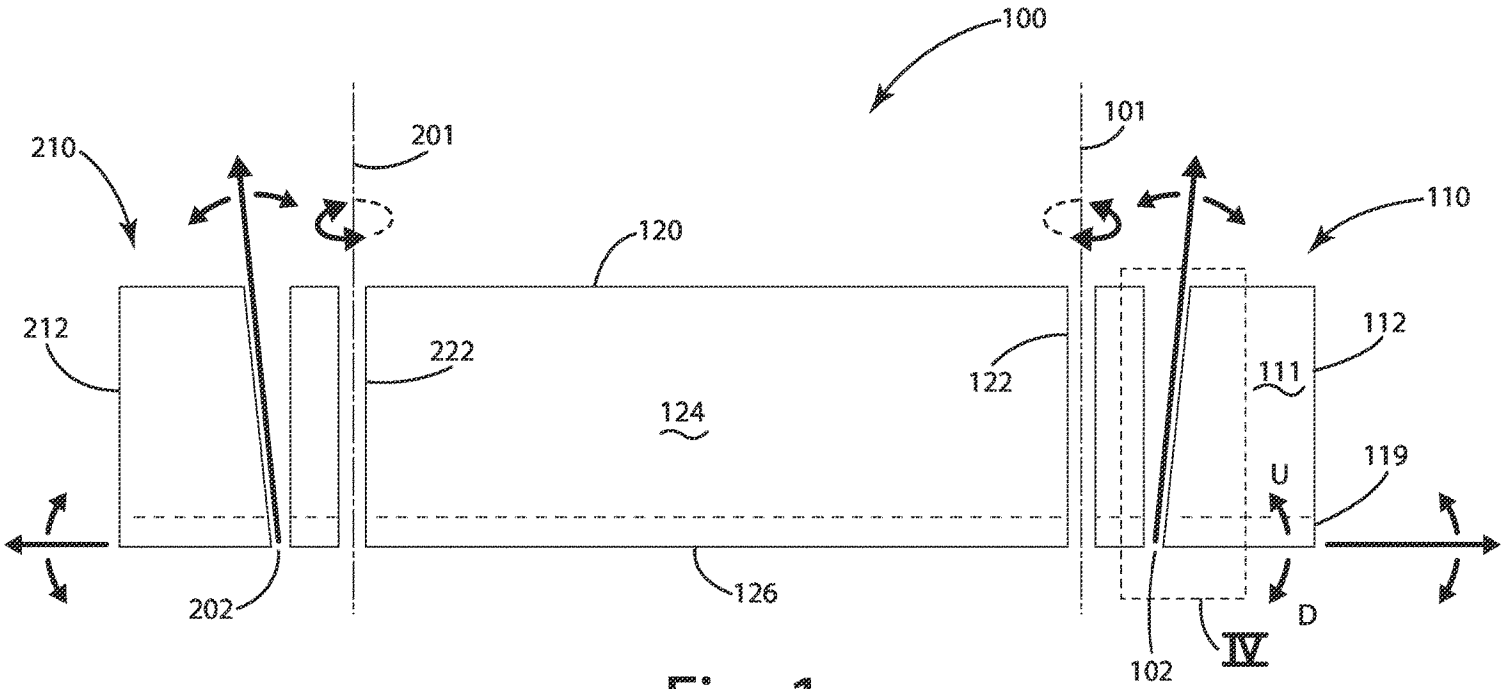
FIG. 1 shows a representative view of a snow plow in accordance with one embodiment.
Figure 2:
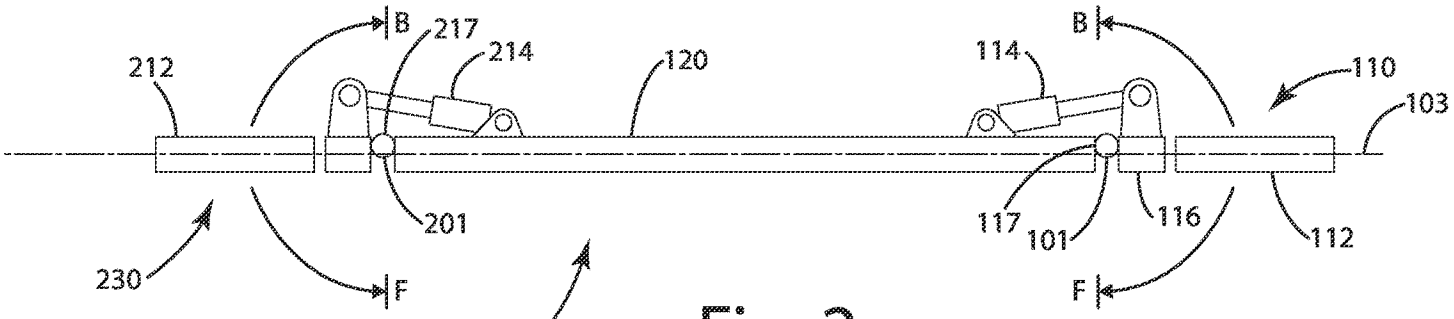
FIG. 2 shows a representative view of the snow plow of FIG. 1.
Figure 3:
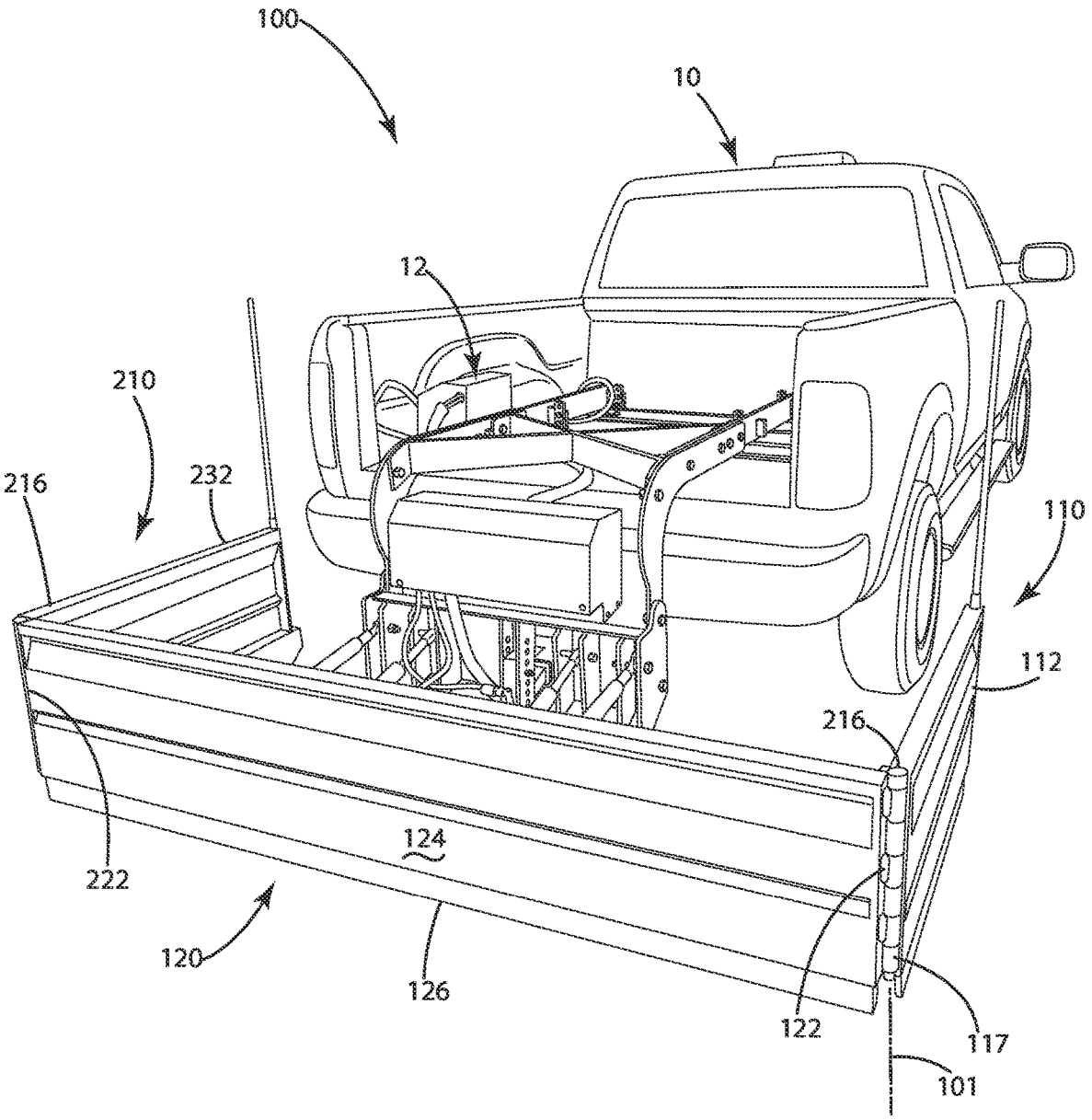
FIG. 3 shows a perspective view of a snow plow in accordance with one embodiment.

A snow plow for a vehicle is shown in FIGS. 1-3, and is generally designated 100. The snow plow 100 is described herein in several embodiments as being a back-blade type of plow disposed proximal to a rear of a vehicle 10. The snow plow 100 is further described in several embodiments as a front-blade type of plow mounted to the front of the vehicle 10. However, it is to be understood that the present disclosure is not so limited. The snow plow 100 includes a primary plow 120 having a longitudinal axis 103 and first and second respective sides 122, 222. The primary plow 120 may include a mold board 124 and a blade 126 operable to displace snow or other debris from a ground surface, such as a driveway or parking lot. It is to be understood that the present disclosure, although described in conjunction with a snow plow, is not limited to a snow plow configured primarily for displacing snow. For instance, the snow plow 100 in an alternative embodiment may be configured as a general plow or blade (e.g., a bulldozer blade) for primarily moving debris or objects other than snow (e.g., snow removal may be an incidental function of the general plow or blade).

In the illustrated embodiments of FIGS. 1-3, the blade 126 of the primary plow 120 may be a wearable component that can be replaced as the edge of the blade 126 wears away. Example types of blades include a polymer-based blade, such as a polyurethane blade or a rubber-based blade, and a metal blade, such as heat treated steel. The blade 126 may be attached to the mold board 124 in a fixed position such that the blade 126 is stationary. Alternatively, the blade 126 may be attached to the mold board 124 in a trippable configuration, such that the blade 126 remains generally stationary in use until an obstruction is encountered that exerts a force on the blade 126 that is greater than a threshold trip force, at which point the blade 126 may move (e.g., rotate relative to a bottom edge of the mold board 124) in order to yield to the obstruction.

The mold board 124 in the illustrated embodiment may be shaped or configured in a variety of ways, depending on the application. For instance, the mold board 124 in the illustrated embodiment of FIG. 3 provides a planar surface for pushing snow. However, the mold board 124 may be configured differently, such as having a curved surface for facilitating rolling the snow off the snow plow 100.

The snow plow 100 described herein in conjunction with several embodiments includes a first wing 110 including a main wing portion 112 movable about 1) a first axis 101 and 2) a second axis 102. The snow plow 100 may include a second wing 210 configured in a manner that mirrors the first wing 110. Components of the second wing 210 that are similar to the first wing 110 are designated with a 200 series reference number—e.g., the second wing 210 includes a main wing portion 212 similar to the main wing portion 112 of the first wing 110. Accordingly, for purposes of disclosure, the descriptions of the components of the first wing 110 are not substantially duplicated to describe corresponding components of the second wing 210.

In one embodiment, movement of the main wing portion 112 about the second axis 102 may occur in response to encountering an obstruction that exerts an upward force on the main wing portion 112, such that the main wing portion 112 may rotate about the second axis 102 in response to the encounter with the obstruction in order to prevent substantial damage to the snow plow 100 due to the encounter.

In one embodiment, the main wing portion 112 may be rotated about the first axis 101 backward and forward between positions B and F, shown in the illustrated embodiment of FIG. 2. As an example, the main wing portion 112 may be rotated in front of or behind the longitudinal axis 103 of the primary plow 120. Positions B and F may vary from application to application. For instance, in the illustrated embodiment, position B corresponds to a position of approximately +90° relative to the longitudinal axis 103 of the primary plow 120 shown in FIG. 2, and position F corresponds to a position of approximately −90° relative to the longitudinal axis 103 of the primary plow 120. With respect to the second wing 210, in the illustrated embodiment, position F corresponds to an angle of approximately −90°, and position B corresponds to an angle of approximately +90°. In the illustrated embodiment, the angles for the positions F and B for the second wing 210 are similar to the angles for the positions F and B for the first wing 110, but the range of movement for the second wing 210 is different from the range of movement for the first wing 110.

Position F and B correspond to the limits of movement of the main wing portion 112, and may vary depending on the application. It is to be understood that an operator may position the main wing portion 112 at a location between positions F and B in use (e.g., to plow an area or to travel).

For instance, the operator may position the main wing portion 112 at an angle of 20° in use, and then move the main wing portion 112 to position B for travel. It is also noted that the operator may position the main wing portion 112 of the first wing 110 at an angle different from the position of the main wing portion 212 of the second wing 210. For instance, the operator may position the main wing portion 212 of the second wing 210 at an angle of +200° (or)−160° about the first axis 201, and position the main wing portion 112 of the first wing 110 at an angle of −20° about the first axis 101, thereby positioning one wing forward of the longitudinal axis 103 and the other wing aft of the longitudinal axis 103.

In one embodiment, regardless of the longitudinal axis 103 or the position and configuration of the primary plow 120, position B may correspond to an angle about the first axis 101 that disposes the first wing 110 in a stowed position such that the main wing portion 112 is generally proximal to and parallel to a side of the vehicle to which the snow plow 100 is mounted. This way, with the first wing 110 in the stowed position, the snow plow 100 may fit within the width constraints imposed by a municipal road for travel thereon.

The first wing 110 may include a secondary wing portion 116 pivotably coupled to the primary plow 120 to facilitate rotation of the first wing 110 about the first axis 101. The secondary wing portion 116 may be pivotably coupled to the primary plow 120 via a joint 117, which may be defined by a hinge and pin configuration that is provided between the first side 122 and the secondary wing portion 116 and that allows rotation of the first wing 110 about the first axis 101. The secondary wing portion 116 may be moved via an actuator 114 (e.g., a hydraulic actuator) capable of extending and retracting to rotate the first wing 110 between positions F and B about the first axis 101.

In an alternative embodiment, the actuator 114 may be operable to allow the first wing 110 to pivot toward position B in response to encountering an object that exerts a force greater than a tripping threshold. For instance, the actuator 114 may be configured to retract in response to a force that is applied on the first wing 110 in a direction normal or perpendicular to the first axis 101 and that is greater than the tripping threshold. In this way, the first wing 110 may be configured to yield in response to encountering an obstruction. Example configurations for retracting an actuator 114 in response to an obstruction are described herein, and may be implemented in conjunction with the actuator 114; however, it is to be understood that any type of tripping mechanism may be implemented in conjunction with the first wing 110 to facilitate yielding in response to encountering significant obstructions.

The first wing 110 may include a wing blade 119, similar in some respects to the blade 126 of the primary plow 120. For instance, the wing blade 119 may be a wearable blade capable of being replaced when considered appropriate. The wing blade 119 may also be made of material similar to the blade 126 of the primary plow 120, such as being made of a polymer or metal material. In the illustrated embodiment, the wing blade 119 may be coupled to a mold board portion 111 of the main wing portion 112 in a stationary manner (e.g., via fasteners). Alternatively, similar to an alternative embodiment of the blade 126, the wing blade 119 may be coupled to the mold board portion 111 in a manner that allows the wing blade 119 to pivot relative to the bottom edge of the mold board portion 111 in response to encountering an objection that applies a force on the wing blade 119 that exceeds a threshold tripping force. The threshold may be determined based on a variety of factors, including, for instance, a target amount of force for moving debris, strength of the snow plow 100 and the first wing 110.

The main wing portion 112 of the first wing 110 in the illustrated embodiment of FIG. 1 is operable to rotate about the second axis 102. The main wing portion 112 may be pivotably coupled to the secondary wing portion 116 such that the main wing portion 112 may rotate about the second axis 102 between positions U and D shown in the illustrated embodiment of FIG. 1. Positions U and D may be determined based on target operating conditions. For instance, position U may be determined to be approximately 6 inches of rise with respect to the ground surface or the bottom edge of the blade 126 of the primary plow 120. Six inches in this example is considered sufficient displacement in order to yield to an obstruction encountered in a driveway or parking lot without significant damage to the snow plow 100 or vehicle 10. It is noted that position U described herein corresponds to an upper limit of movement of the main wing portion 112. The main wing portion 112 may be positioned lower than the upper limit corresponding to position U.

The obstruction may be encountered in a variety of ways. For instance, when the first wing 110 is rotated about the first axis 101 at −90° in the position F, the toe of the first wing 110 may be susceptible to encountering an object. If such an object is encountered in this position, the first wing 110, as discussed herein, may rotate upward about the second axis 102. Such object may take the form of a curb or parking lot divider.

In an alternative example, the first wing 110 may be rotated about the first axis 101 at 0° between positions F and B, and an obstruction may be encountered by the wing blade 119 that applies an upward force on the first wing 110. Such a force, if above a threshold force, may cause the main wing portion 112 to rotate upward as discussed herein.

Turning to position D, the main wing portion 112 may pivot downward relative to the second axis 102 to position D, which may vary depending on the application. In the illustrated embodiment, position D corresponds to approximately 3 inches of downward displacement with respect to the bottom edge of the blade 126 of the primary plow 120. Similar to position U, position D is considered limited with respect to movement of the main wing portion 112, such that the main wing portion 112 may be positioned between positions U and D. Position D, in one embodiment, may be determined based on the possible extent of wear to the wing blade 119 (e.g., the difference between a new wing blade 119 and a wing blade 119 that is considered to need replacing) and degree of terrain variation to be encountered by the main wing portion 112.

In one embodiment, undulations or unevenness in a driveway or parking lot may be encountered by the first wing 110. The main wing portion 112 may be biased toward position D, such that contact between the wing blade 119 and the ground is maintained to the extent the undulations are within the range between positions U and D.

Figure 4:
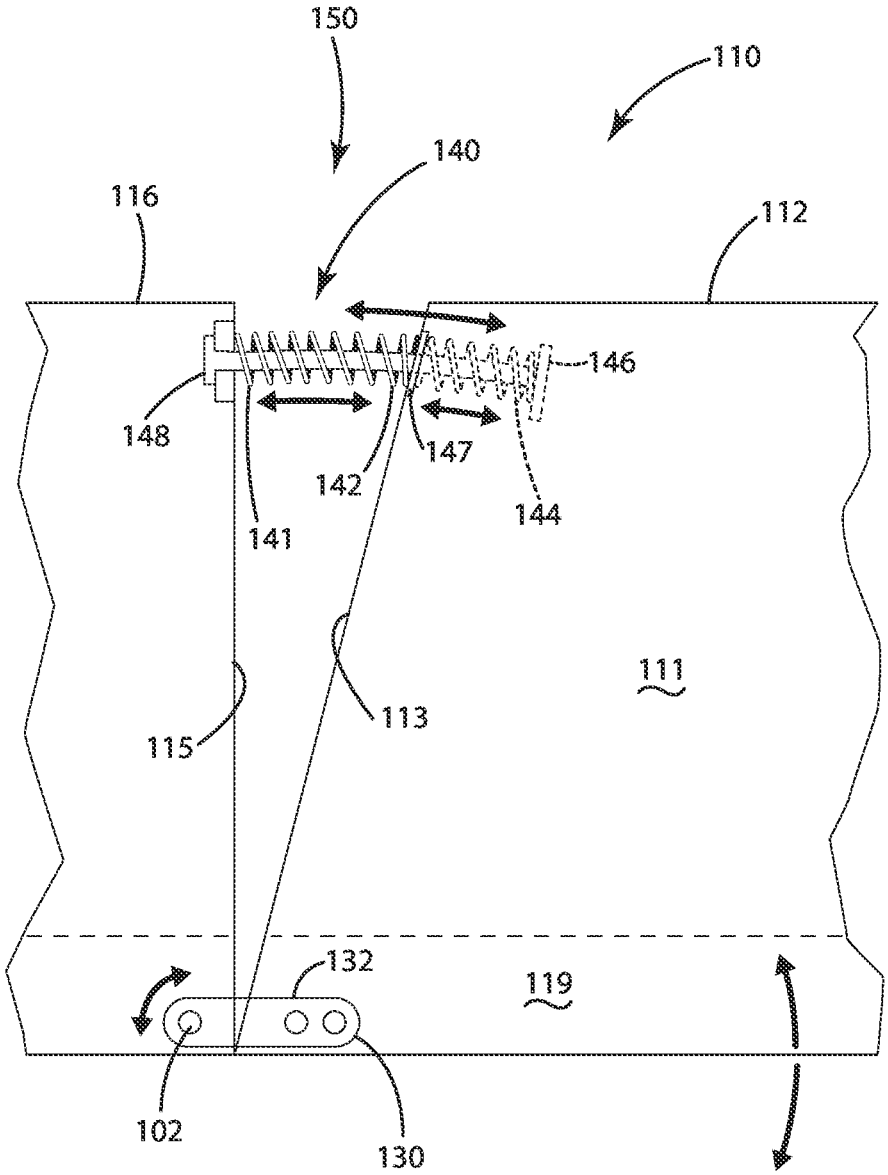
FIG. 4 shows an enlarged view of FIG. 1 in accordance with one embodiment.

The connector 150 between the main wing portion 112 and the secondary wing portion 116 of the first wing 110 is shown in further detail in the illustrated embodiment of FIG. 4. The connector 150 may include an upper connector 140 and a lower connector 130. The lower connector 130 may include a plate 132 fixedly connected to the main wing portion 112 and pivotably connected to the secondary wing portion 116, enabling the main wing portion 112 to pivot or rotate about the second axis 102.

In the illustrated embodiment, the upper connector 140 of the connector 150 may be configured to substantially prevent movement of the main wing portion 112 relative to the secondary wing portion 116 in a direction parallel to the second axis 102. The upper connector 140, on the other hand, may be configured to allow rotation of the main wing portion 112 relative to the secondary wing portion 116 with respect to the second axis 102.

The upper connector 140, in the illustrated embodiment, includes first and second springs 142, 144 and a linkage 141. The linkage 141 may be connected to an anchor 148 of the secondary wing portion 116 and may be operable to slide within a slot of a spring interface 147 of the main wing portion 112.

The first and second springs 142, 144 may be configured to act against each other in compression with a balanced position corresponding to a target position of the lower edge of the wing blade 119 being generally parallel with the lower edge of the blade 126 of the primary plow 120. The first spring 142 may compress relative to an anchor 148 of the secondary wing portion 116 and a spring interface 147 of the main wing portion 112, enabling the main wing portion 112 to rotate upward to position U in response to a force applied upward on the main wing portion 112 that is greater than a threshold force (which depends at least in part on the stiffness of the first spring 142). In the illustrated embodiment, the second spring 144 may operate in compression between a floating anchor 146 and the spring interface 147, enabling the first spring 142 to urge the main wing portion 112 toward position D but not further than position D. That is, at position D, the first and second springs 142, 144 may be in equilibrium, where, in operation and in contact with the ground, the main wing portion 112 may be disposed between positions U and D, and where, in a raised position where the snow plow 100 is lifted off the ground, the main wing portion 112 may rotate to position D. The first spring 142 and second spring 144 in this relationship may operate to urge the wing blade 119 toward the ground to maintain contact between the ground and the wing blade 119 (despite wear).

Figure 5:
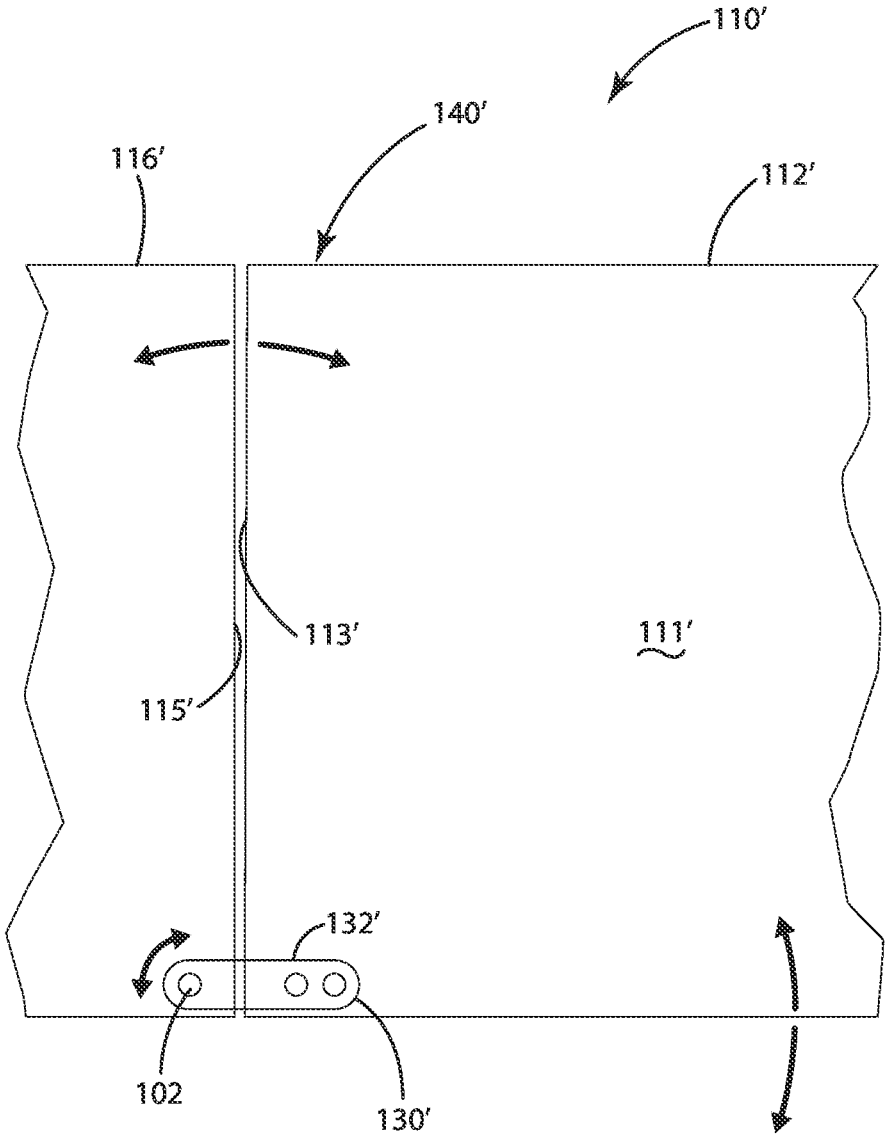
FIG. 5 shows an alternative embodiment of the snow plow in accordance with one embodiment.

It is noted that in the illustrated embodiments of FIGS. 1, 2, and 4, the main wing portion 112 is shown with a gap between the sides 113, 115 that increases in size from the lower connector 130 to the upper connector 140. In this configuration, the side 113 of the main wing portion 112 may move closer to the side 115 of the secondary wing portion 116 as the main wing portion 112 moves toward position U and the first spring 142 is compressed. Alternatively, as depicted in the illustrated embodiment of FIG. 5, a first wing 110' is provided similar in some respects to the first wing 110 with several exceptions, including a main wing portion 112' having a side 113' that is proximal to the side 115' of the secondary wing portion 116' such that, with the bottom edge of the main wing portion 112' being substantially parallel to the bottom edge of the secondary wing portion 116', the gap between the sides 113', 115' is substantially the same from between the lower and upper connectors 130', 140'. The upper part of the main wing portion 112', proximal to the upper connector 140', may move behind or in front of the secondary wing portion 116' as the main wing portion 112' rotates about the second axis 102.

Figure 6:
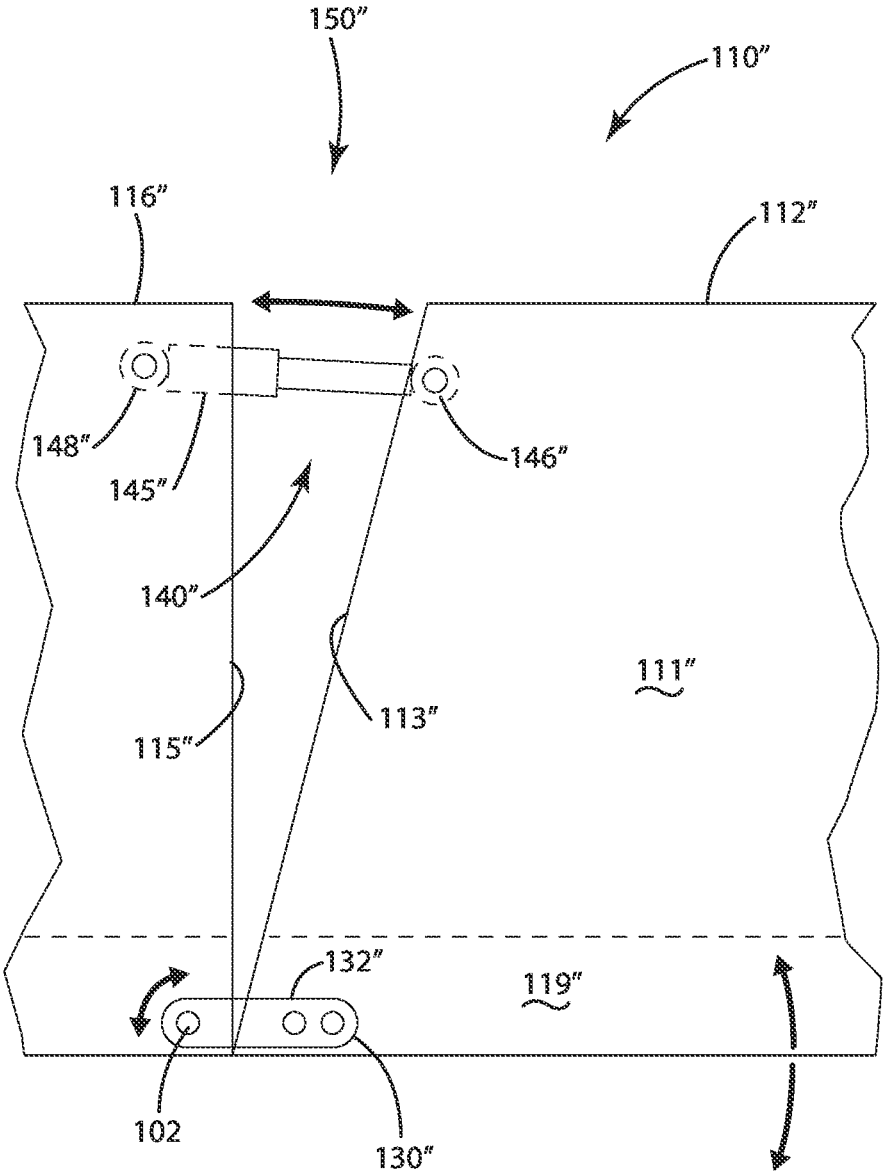
FIG. 6 shows an alternative embodiment of the snow plow in accordance with one embodiment.
Figure 7:
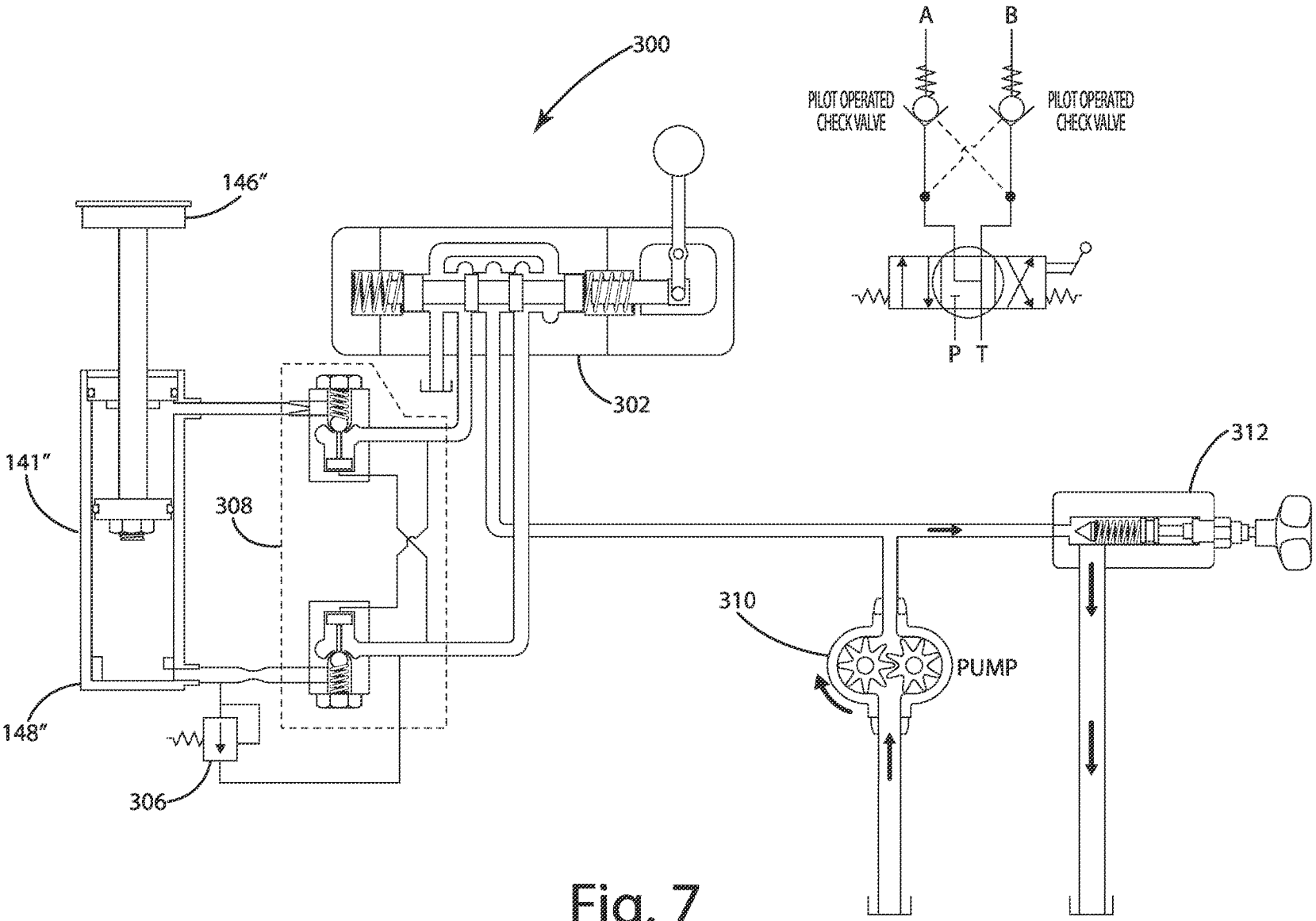
FIG. 7 shows a control system of the snow plow in accordance with one embodiment.

In an alternative embodiment, depicted in the illustrated embodiment of FIGS. 6 and 7, a first wing 110" is provided similar in some respects to the first wing 110, 110' with several exceptions. The first wing 110" may include a main wing portion 112" with a mold board portion 111" and a wing blade 119", similar to the main wing portion 112, mold board portion 111 and wing blade 119. The first wing 110" may include a lower connector 130" and an upper connector 140" that form part of the connector 150" that couples the main wing portion 112" to the secondary wing portion 116". The lower connector 130" may be similar to the lower connector 130, including a plate 132" that facilitates rotation of the main wing portion 112" about the second axis 102.

The upper connector 140" in the illustrated embodiments of FIGS. 6 and 7 may be an actuator 145" connected to an anchor 148" of the secondary wing portion 116" and an anchor 146" of the main wing portion 112". The actuator 145" may be operable to extend or retract to rotate the main wing portion 112" about the second axis 102. In one embodiment, the actuator 145" may be configured to automatically retract in response to application of force above a threshold trip force on the main wing portion 112" along an axis perpendicular to the second axis 102 (e.g., an upward force on the wing blade 119" that occurs in response to encountering an object). Optionally, the actuator 145" may be configured to extend to rotate the main wing portion 112" into contact with the ground (within the limit of position D) in response to withdrawal of the force that was above the threshold force. Additionally, or alternatively, the actuator 145" may be configured to operate as a type of spring retracting and extending in response to a force less than the threshold trip force in a more controlled, gradual, or slower manner than in retraction in response to a force greater than the threshold trip force.

In the illustrated embodiment of FIG. 7, the actuator 145" is a hydraulic actuator having a cylinder side coupled to the anchor 148" and a rod side coupled to the anchor 146". A control system 300 may be operable to direct operation of the actuator 145", and may include a directional control valve 302 that, in conjunction with the pilot operated check valves 308, enables an operator to extend or retract the piston of the actuator 145" based on the position of the directional control valve 302. The directional control valve 302 is shown in the illustrated embodiment with a manual actuator; however, the present disclosure is not so limited. The directional control valve 302 may be operated via an electromechanical controller.

In operation, the directional control valve 302 positioned to connect the pump side to the cap-end of the actuator 145" and the rod-end to the tank reservoir. The pilot actuated check valves 308 may allow the hydraulic fluid to flow from the pump 310 such that the rod extends, causing the anchor 146" to rotate the main wing portion 112" downward toward position D. The relief valve 312 may divert fluid to the tank reservoir in response to the rod of the actuator 145" dead heading or encountering resistance above a threshold. After the operator has extended the actuator 145" to a target position, the directional control valve 302 may be positioned to a neutral position, causing the pilot actuated check valves 308 to close in order to maintain pressure within the actuator 145" to maintain the extended position of the actuator 145".

In the illustrated embodiment, the control system 300 includes an adjustable relief valve 306 configured to crack and allow fluid to flow from the cylinder-side of the actuator 145" to the tank reservoir in response to pressure greater than a threshold pressure. The threshold pressure may be determined based on an adjustment of the adjustable release valve 306, and may be configured to correspond to a target threshold trip force for the actuator 145". In response to the adjustable relief valve 306 opening, the cylinder side and the rod side of the actuator 145" may float, allowing the rod to retract into the cylinder in response to continued application of force above the threshold trip force. This mode of operation may enable the actuator 145" to allow the main wing portion 112" to move toward position U in response to application of force above the threshold trip force. After such a force is withdrawn, the operator or control system 300 may direct the actuator 145" to re-extend for using the first wing 110" to move snow.

Figure 8:
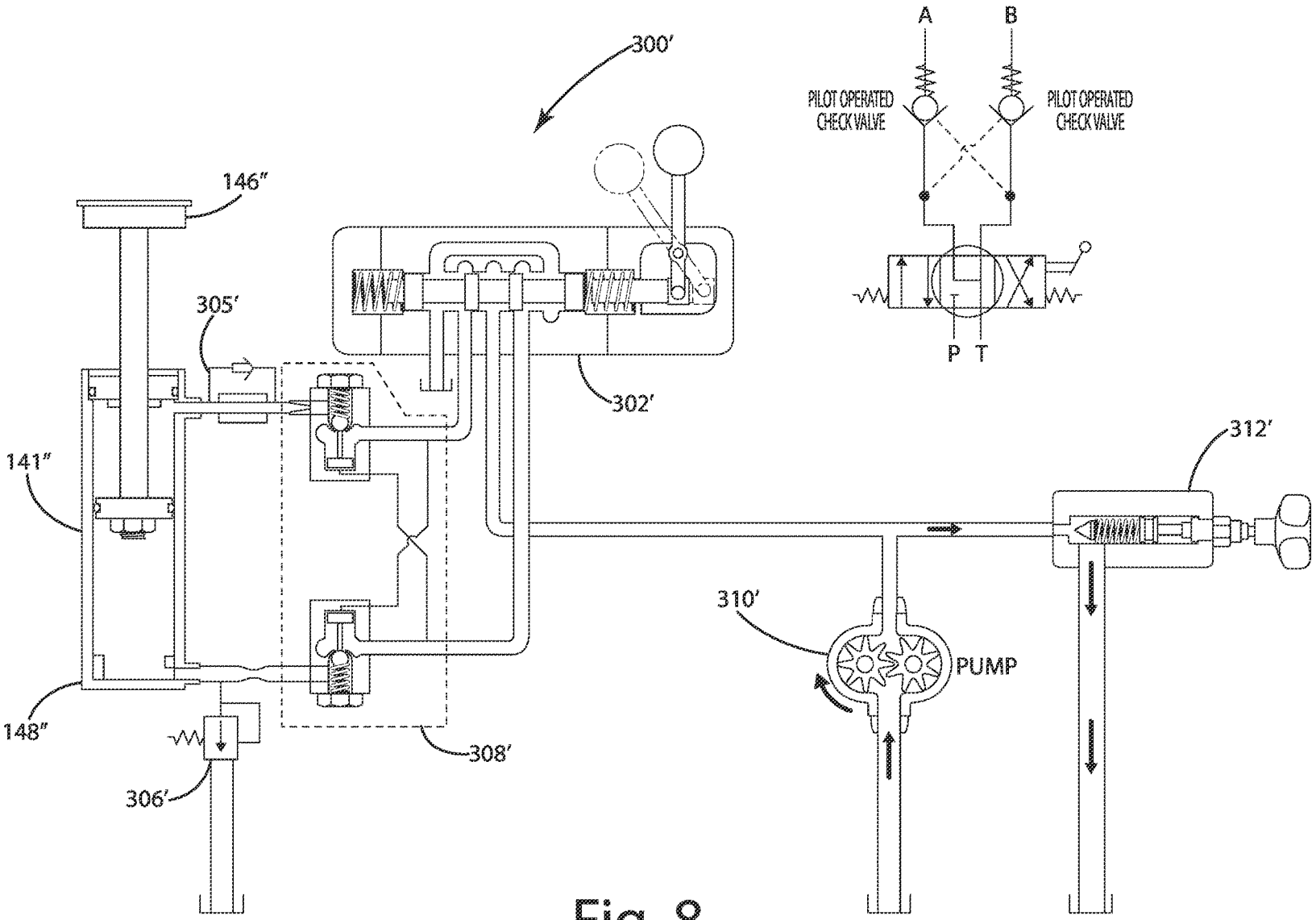
FIG. 8 shows a control system of the snow plow in accordance with one embodiment.

An alternative embodiment of the control system is shown in FIG. 8, and designated 300'. The control system 300' may include pilot actuated check valves 308', a pump 310', a relief valve 312', and a directional control valve 302' similar to the correspondingly referenced components of the control system 300. The adjustable relief valve 306' in the illustrated embodiment is operable to divert fluid from the cylinder-side of the actuator 145" to the tank, allowing the actuator 145" to retract in response to application of force greater than the threshold trip force. The directional control valve 302' may be left in a position to extend the rod of the actuator 145" such that after the force is removed, the rod is extended to an operating position.

In the illustrated embodiment of FIG. 8, the rod-side flow path includes a check valve and a restrictor 305' operable to allow fluid flow into the rod-side more quickly than out of the rod-side. This configuration may enable the actuator 145" to retract more quickly than it extends.

The snow plow 100 may be coupled to the vehicle 10 in a variety of ways, as discussed herein. The snow plow 100 in the illustrated embodiment of FIG. 3 is coupled to the vehicle via a hitch system 12. The hitch system 12 may interface with the snow plow 100 to enable removable coupling between the vehicle 10 and the snow plow 100. As discussed herein, the snow plow 100 is shown coupled to a rear of the vehicle 10; however, the present disclosure is not so limited. The snow plow 100 may be coupled to the front of the vehicle 10 via a hitch system or vehicle connection system configured to facilitate such a connection to the front of the vehicle 10. An example hitch system for the snow plow 100, in one embodiment, is described in U.S. Pat. No. 10,150,428, entitled ADAPTABLE HITCH SYSTEM, filed Feb. 19, 2018, issued Dec. 11, 2018, to Weihl—the disclosure of which is hereby incorporated by reference in its entirety. An example connection system for the snow plow, in one embodiment, is described in U.S. Patent Application 62/940,590, entitled PLOW ASSEMBLY LINKAGE, filed Nov. 26, 2019, to Weihl—the disclosure of which is hereby incorporated by reference in its entirety.

Figure 9:
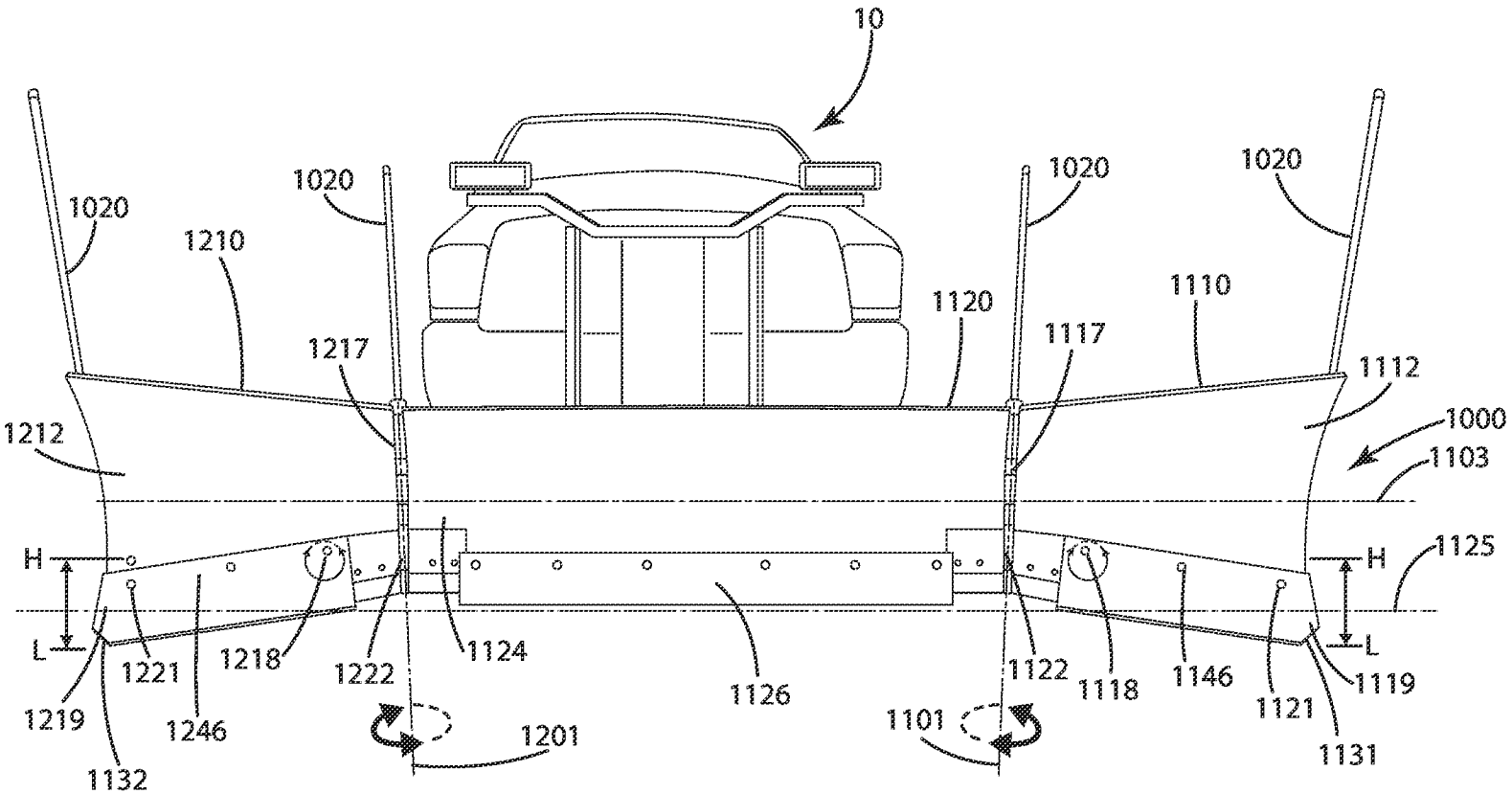
FIG. 9 shows a perspective view of a snow plow in accordance with one embodiment.

In an alternative embodiment, a snow plow 1000 is a front-blade plow. One embodiment of the snow plow 1000 as a front-blade plow mounted to the front of the vehicle 10 is depicted in FIG. 9. The snow plow 1000 may be similar to the snow plow 100 described above with the primary exception of its mounting position on the vehicle 10. However, the snow plow 1000 has some differences from one or more embodiments described herein. The snow plow 1000 may be coupled to a vehicle support 1412 via a plow support 1380.

In one embodiment, the snow plow 1000 may include a primary plow 1120 coupled to the plow support 1380. The snow plow 1000 may also include a first wing 1110 and a second wing 1210. The first wing 1110 may be rotatably coupled to the primary plow 1120 on a first side 1122 via a joint 1117. The joint 1117 may vary from application to application, and is depicted as a hinge and pin configuration but the disclosure is not so limited. The joint 1117 allows the first wing 1110 to rotate about an axis 1101 to position F and position B as described with respect to FIG. 2. However, position F and position B may not be at the same angular positions as described above and may vary based on the application. Rotation about the axis 1101 allows the first wing 1110 to rotate toward the vehicle 10 to position B, which may allow the vehicle 10 to fit within a standard vehicle lane while travelling. The first wing 1110 can also rotate away from the vehicle 10 to position F. The first wing 1110 may be rotated by an actuator 1114, which is described below with reference to FIG. 10. In the illustrated embodiment a limiter 1135 is provided to contact a surface 1139 of the first wing 1110 at one or more limit positions to prevent further movement. In the illustrated embodiment, the limiter may be configured to interface with the first wing 1110 at positions F and B to prevent further rotation outside the range between F and B.

Components of the second wing 1210 that are similar to the first wing 1110 are designated with a 1200 series reference number—e.g., the second wing 1210 may rotate about an axis 1201 similar to how the first wing 1110 may rotate about an axis 1101. Accordingly, for purposes of disclosure, the descriptions of the components of the first wing 1110 are not substantially duplicated to describe the corresponding components of the second wing 1210.

The first wing 1110 may include a main wing portion 1112 and a wing blade 1119. The wing blade 1119 may be fixedly connected to the main wing portion 1112, or the wing blade 1119 may be able to rotate upwards, for example in response to a change in contour of the ground or encountering debris or an obstruction that exerts a force greater than a tripping threshold. In one embodiment, the wing blade 1119 may include a pivot portion 1118 and a sliding portion 1121. In the depicted embodiment, the sliding portion 1121 includes a fastener seated within or captured by a channel to allow the wing blade 1119 to move upward in response to an upward force (e.g., a tripping force or the ground in response to a change in surface contour), while maintaining a coupling between the sliding portion 1121 and the main wing portion 1112. The wing blade 1119 may rotate about the pivot portion 1118 such that the sliding portion 1121 moves from position L to position H. The position L may correspond to a position lower than a ground contacting plane 1125 defined by the blade 1126 of the primary plow 1120, and position H may correspond to a position higher than this ground contacting plane 1125 defined by the wing blade 1119. In use, the position of the sliding portion 1121 of the wing blade 1119 may be between position L and H with the sliding portion 1121 contacting the ground. The position of the sliding portion 1121 may vary as the contour of the ground changes. As described herein, the sliding portion 1121 of the wing blade 1119 may be biased toward the ground such that, as the plow 1000 travels along the ground and the ground contour lowers relative to a current position of the sliding portion 1121, the sliding portion 1121 may lower toward position L to follow the contour of the ground. Conversely, the sliding portion 1121 may lift toward position H as the ground contour rises as the plow travels over the ground and the height of the ground near the sliding portion 1121 is different from the height of the ground near the pivot portion 1118. The bias force may vary from application to application, and may be determined selectable, in operation, installation, or the design stage, or a combination thereof, to enable the sliding portion 1121 of the wing blade 1119 to substantially maintain contact of the wing blade 1119 with the ground and to allow upward movement in response to changes in ground contour and/or an encounter with an obstruction.

In one embodiment, a distal portion 1131 of the wing blade 1119 distal from the pivot portion 1118 may be angled or sloped, which may allow the distal portion 1131 to engage a potential obstruction and cause the wing blade 1119 to pivot upward toward H in response to encountering the obstruction. The wing blade 1119 in the illustrated embodiment pivots about an area proximal to the pivot portion 1118, such that the pivot portion 1118 is near to or aligned with the plane of the adjacent segment's blade (e.g., main blade 1126). In response to the distal portion 1131 encountering an obstruction, the distal portion 1131 may begin to ride over the obstruction, causing the wing blade 1119 to pivot upward toward position H, and allowing the entire undersurface of the wing blade 1119 to ride over the obstruction. In this circumstance, because the undersurface of the wing blade 1119 leads to the pivot portion 1118 near or aligned with the plane of the main blade 1126, the wing blade 1119 may raise the main blade 1126 to clear the obstruction. As described herein, a movable component capable of pivoting in accordance with one or more embodiments described in conjunction with the wing blade 1126 may be incorporated into any segment of a plow construction, including segments of a V-blade. And although the wing blade 1126 is shown operable to pivot relative to an area proximal to a connection to another segment of a plow, it is to be understood that the wing blade 1126 may pivot relative to an area distal from a connection to another segment of the plow.

The distance from position L to position H may vary depending on the application. In one example, the distance from position L to position H may be six inches, with L being two inches lower than the ground contacting plane 1125, and H being four inches higher than the ground contacting plane 1125. Six inches in this example is considered sufficient displacement in order to yield to an obstruction encountered in a driveway or parking lot without significant damage to the snow plow 1000 or vehicle 10, or to follow changes in the contour of the ground while maintaining contact with the ground. It is noted that position H described herein corresponds to an upper limit of movement of the wing blade 1119. Depending on the strength of the tripping force exerted on the wing blade 1119 and the changes in contour of the ground, the sliding portion 1121 might not move all the way up to position H.

The wing blade 1119 and the blade 1126 are wearable components of the snow plow 1000, generally meaning that the ground contacting surfaces of the wing blade 1119 and the blade 1126 wear away in response to repeated contact with the ground. Because the sliding portion 1121 of the wing blade 1119 is biased downward, in one embodiment, despite wear of the wing blade 1119 or the blade 1126, or both, the sliding portion 1121 may be operable to maintain contact with the ground.

The distance L may vary as the wing blade 1119 wears away near the sliding portion 1121 and the pivot portion 1118 of the wing blade 1119. For instance, as the main blade 1126 wears, the pivot portion 1118 of the wing blade 1119 may wear as well, raising the ground contacting plane 1125 over time relative to a new set of blades. The sliding portion 1121 may or may not wear at the same rate as the pivot portion 1118 and the main blade 1126. However, because the sliding portion 1121 may raise and lower, despite changes in the ground contacting plane 1125, the sliding portion 1121 may be operable to maintain contact with the ground. If the sliding portion 1121 wears away in this configuration, the amount of allowable travel (e.g., L, H, or both) may vary. The sliding portion 1121 may wear such that L, H, or both, are considered insufficient, such as the upward movement capability H becoming insufficient to allow the sliding portion 1121 to move upward to track changes in ground contour or to move in response to encountering an obstruction.

In one embodiment, the wing blade 1119 may be referred to as the main wing portion and the main wing portion 1112 may be described as a secondary portion of the wing blade 1119. For instance, the first wing 1110 and a similarly configured second wing 1210 may be incorporated into the snow plow 1000 described herein, with the wing blade 1119 of the first wing 1110 being the main wing portion of the snow plow 1000 that is capable of pivoting, and the main wing portion 1112 of the first wing 1110 being the secondary portion of the snow plow 1000 that is coupled to a first side of primary plow of the snow plow 1000. The wing blade 1119 may rotate about a second axis between position L and position H similar to rotation of the main wing portion 112 of FIGS. 1-6 being allowed about the axis 102 between position U and position D. The main wing portion 1112 may be rotatably coupled to the primary plow 1120 similar in rotation of the secondary wing portion 116 of FIGS. 1-6 relative to a first side of the primary plow 120 about the axis 101.

Figure 10:
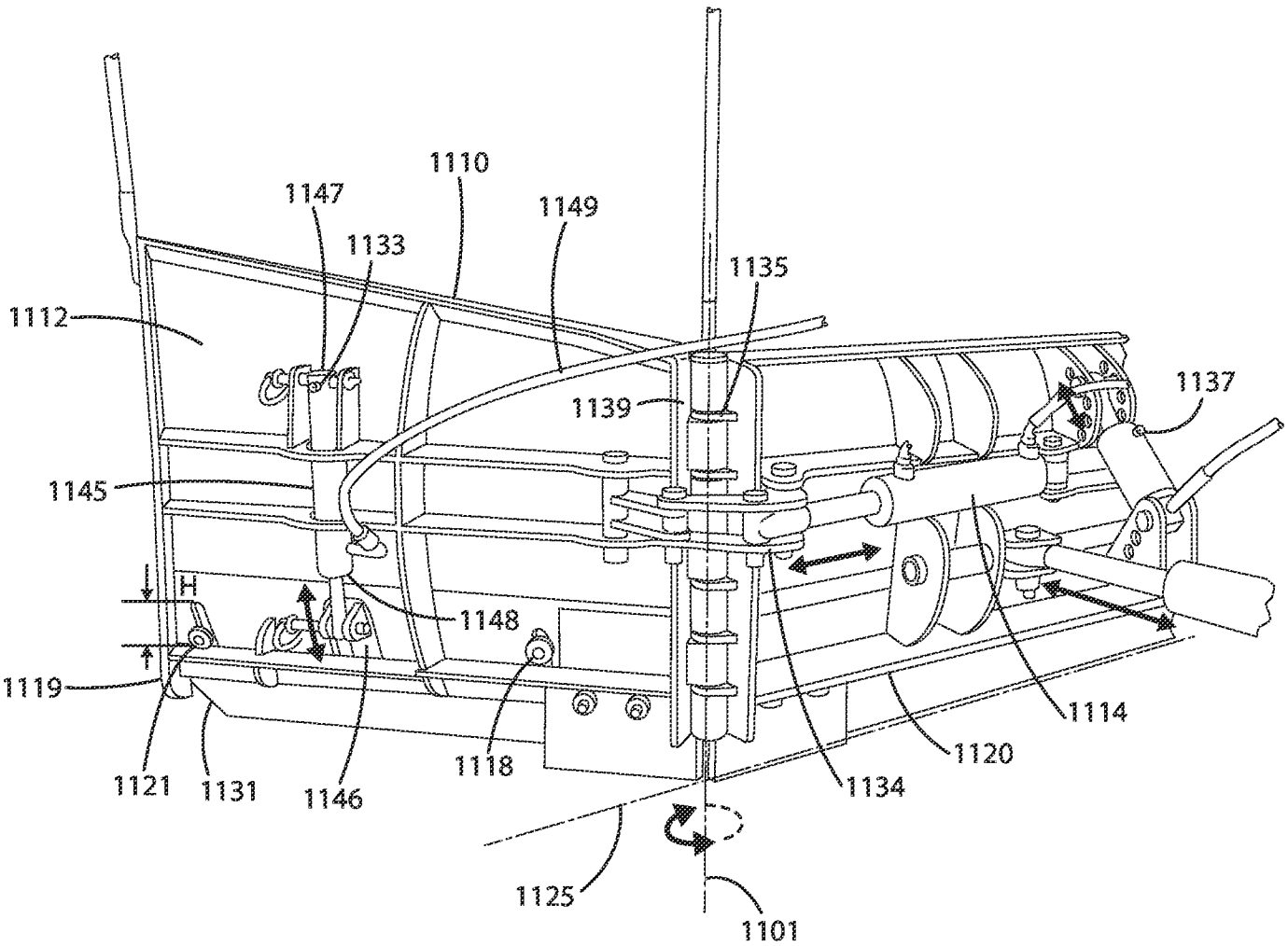
FIG. 10 shows a rear perspective view of a portion of the snow plow of FIG. 9.

Turning to the illustrated embodiment of FIG. 10, a rear perspective view of a portion of the snow plow 1000 is shown. FIG. 10 shows the rear of the first wing 1110 and the primary plow 1120. In one embodiment, the wing blade 1119 may move from position L to position H based on movement of an actuator 1145. In the depicted embodiment, the actuator 1145 is a hydraulic actuator having a cap side 1147 coupled to the main wing portion 1112 and a rod side 1148 coupled to an anchor 1146. The anchor 1146 is coupled to the wing blade 1119 and operable to move the wing blade 1119. In the depicted embodiment, the cap side 1147 of the actuator 1145 is filled with a compressible gas (e.g., nitrogen gas), which biases the rod toward an extended position, which is downward in the illustrated embodiment. An amount of hydraulic fluid on the rod side 1148 of the actuator 1145 may be selectively changed, e.g., by increasing or decreasing the fluid pressure on the rod side 1148. The hydraulic fluid pressure on the rod side 1148 may be transitioned to a float mode in which the hydraulic fluid is neither increasing or decreasing the fluid pressure on the rod side 1148. In this float mode, the compressible gas may extend the actuator 1145 until sufficient resistance is met from either the ground by the wing blade 1119 or a mechanical limit of extension of the actuator 1145.

In one embodiment, the cap side 1147 of the actuator 1145 may include an accumulator for the compressible gas. The accumulator may be integrated into the cap side 1147 of the actuator 1145 or may be external to the actuator 1145. By providing compressible gas on one side of the actuator 1145, a hydraulic coupling to this side of the actuator 1145 can be left out or absent from the hydraulic system. As a result, in one embodiment, the actuator 1145 may be coupled to only one hydraulic hose 1149 or a single hydraulic coupling. The greater the number of hydraulic hoses and couplings, the greater the complexity of the system, for installation, operation, and maintenance. With fewer hydraulic hoses and couplings in accordance with one embodiment, the installation time and maintenance time of the snow plow 1000 may be reduced, and operation can be more robust. Conventional hydraulic systems require more complicated control as operation requires that hydraulic fluid is pushed to one side of the cylinder while simultaneously being removed from the other. One embodiment according to the present disclosure may not rely on simultaneous control of fluid on the rod side 1148 and the cap side 1147 of the actuator 1145.

Although the present disclosure is described in conjunction with the cap side 1147 including a compressible gas, biasing the actuator 1145 toward an extended position, the present disclosure is not so limited. Alternatively, the rod side 1148 may include a compressible gas (optionally coupled to an external accumulator), and the cap side 1147 may be coupled to a hydraulic system for controlling the amount of hydraulic fluid in the cap side 1147. This alternative construction may be configured with the compressible gas on the rod side 1148 biasing the actuator 1145 toward a contracted position. As described herein, the actuator 1330 is configured in this manner to facilitate tilting of a top portion of the snow plow 1000 forward about an axis of rotation in response to the blade 1126 encountering an obstruction.

In one embodiment, in response to the wing blade 1119 encountering a sufficient force to overcome the bias of the actuator 1145 (e.g., a tripping force or a change in ground contour), the compressible gas of the cap side 1147 of the actuator 1145 may operate as a spring and allow the rod to move upwards therefore moving the wing blade 1119. In response to a force sufficient to overcome the spring force (e.g., the bias force) of the compressed gas, more hydraulic fluid may flow into the rod side 1148 of the actuator 1145 while the compressible gas compresses (optionally, compressing in an external accumulator). If the force is no longer present, the compressible gas may expand from the accumulator (internal and/or external) back to the cap side 1147 of the actuator 1145, biasing the rod downwards or to an extended position and moving the wing blade 1119 to maintain contact with the ground. The fluid on the rod side 1148 may be forced back to the tank of the hydraulic system by the compressible gas with the force no longer being present. The compressible gas may keep or maintain the sliding portion 1121 of the wing blade 1119 in contact with the ground (or at a set position) even while the other portions of the wing blade 1119 wear away, and even in cases where other portions of the wing blade 1119 are worn such that they are no longer in contact with the ground. It is to be understood that the actuator 1145 is one example of a tripping mechanism, ground follow mechanism, or bias mechanism to a set position, or any combination thereof, and that any type of tripping mechanism, ground follow mechanism, or bias mechanism may be used in conjunction with the wing blade 1119 to facilitate yielding in response to encountering a tripping force and/or in response to forces that overcome the bias force of the actuator 1145. The hydraulic fluid on the rod side 1148 in this example may be provided in a float mode that allows the fluid to readily pass into and out of the rod side 1148 in response to movement of the actuator 1145.

Figure 11:
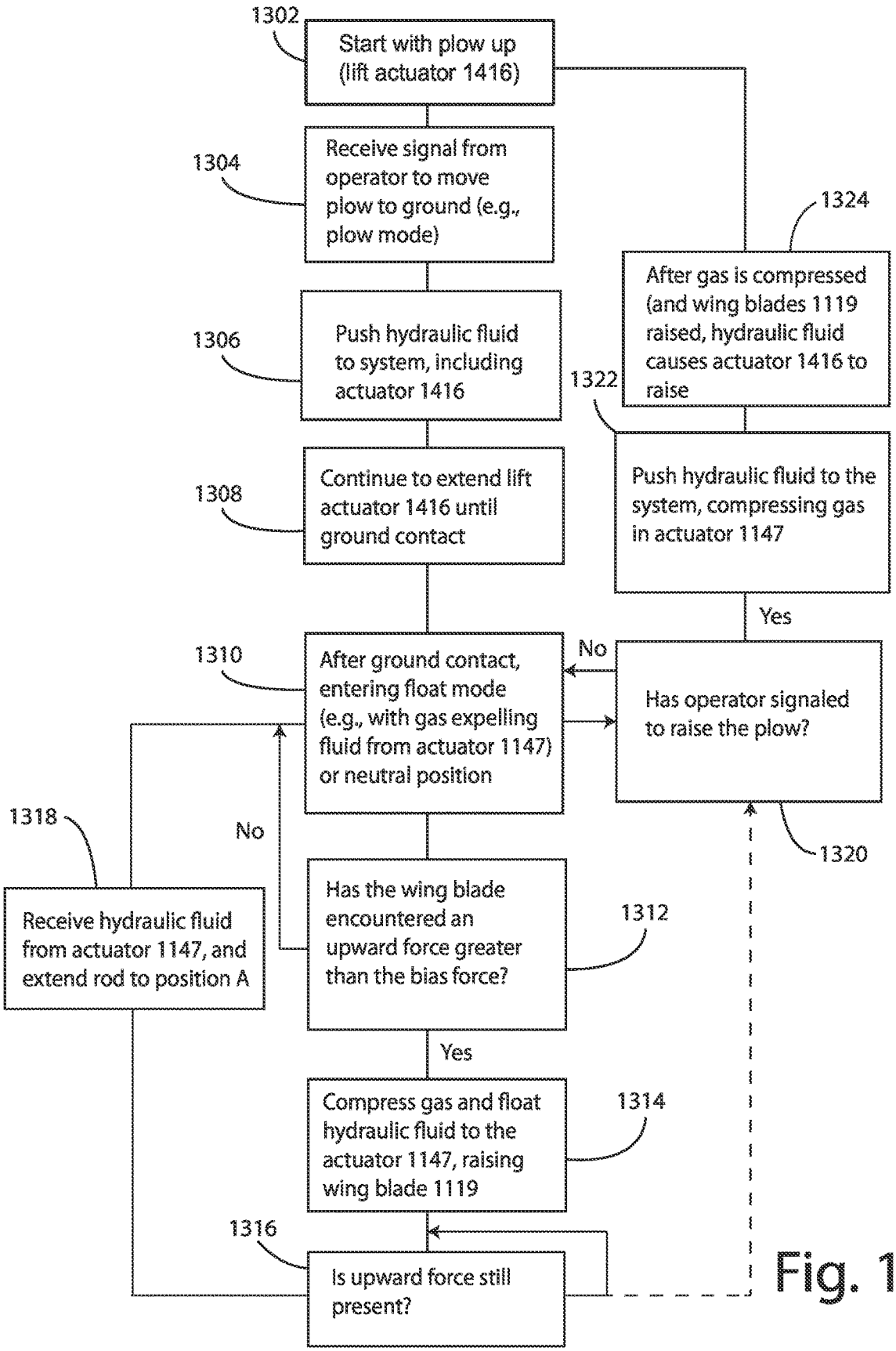
FIG. 11 shows a method of operation for an actuator of a snow plow in accordance with one embodiment.

A control method for the control system in accordance with one embodiment for operation of the actuator 1145 is shown in FIG. 11. The method 1300 is focused generally toward operation of a system configured to retract and extend the wing blade 1119. The control system may be configured to direct operation of one or more other actuators in a similar manner.

In addition to the operation of the actuator 1145 described in conjunction with tripping in response to an obstruction and/or moving based on changes in the ground contour, a control system may be operable to direct operation of the actuator 1145. The control system may provide manual control, electromechanical control, or a combination of the two, over the plow. An operator may control the position of the plow 1000 by signaling the control system to control the hydraulic fluid in the system, such as by extending or retracting the lift actuator 1416. If an operator directs the plow 1000 to move upward, for example to raise the snow plow 1000 for stacking or transport, the operator may signal (e.g., provide user input) to the control system to supply more hydraulic fluid to the rod side of the actuator 1416, thus causing the rod to retract. The supply of hydraulic fluid to the rod side of the actuator 1416 may also be fluidly coupled to the rod side 1148 of the actuator 1416, such that, in response to providing hydraulic fluid under pressure to the rod side of the actuator 1416, the actuator 1145 retracts first (compressing the gas) until a mechanical limit of retraction is reached, and then the lift actuator 1416 raises and retracts. Steps 1320, 1322, 1324.

Conversely, if the operator provides a signal to the control system to lower the plow 1000, the system may supply hydraulic fluid to the cap side of the lift actuator 1416 under pressure and may cause the lift actuator 1416 to extend, and displace fluid from the rod side of the lift actuator 1416 under pressure. Step 1302, 1304, 1306. Because the actuator 1145 is fluidly coupled to the rod side of the lift actuator 1416, this pressure on the rod side of the lift actuator 1416 may maintain the position of the actuator 1145 in the retracted position (with the gas compressed). After the lift actuator 1416 is fully extended such that the plow 1000 contacts the ground (or the mechanical limit of the lift actuator 1416 is reached), the pressure on the rod side of the lift actuator 1416 (due to supply of fluid to the cap side) may subside and the actuator 1145 may extend because the compressed gas in the actuator 1145 is no longer under pressure from fluid on the rod side 1148 of the actuator 1145. Step 1308, 1310. In this way, the actuator 1145 may automatically extend in response to the plow 1000 contacting the ground, and may automatically retract just prior to the plow 1000 being raised off the ground.

In other words, at a start 1302, the rod of the actuator 1416 may be disposed in a retraced position with the plow in an up position (for stacking or transport). The hydraulic pressure on the rod side of the actuator 1416 may also be provided to the rod side 1148 to compress the gas on the cap side 1147 of the actuator 1145, maintaining the wing blade in an up position proximal to position H.

At step 1304, the control system may receive a directive from the operator to lower the plow 1000. Hydraulic fluid may be provided to the lift actuator 1416 under pressure to cause the lift actuator 1416 to extend. In response, hydraulic fluid may be evacuated from the lift actuator 1416 under pressure, maintaining the actuator 1147 in a retracted position. After the lift actuator 1416 extends the plow to the ground position, pressure on the rod side 1148 of the actuator 1145 may subside, allowing the compressed gas to extend the actuator 1145 to move the wing blade 1119 into contact with the ground. Step 1310. The compressed gas may bias the wing blade 1119 toward ground contact, and may allow the wing blade 1119 to move upward automatically in response to changes in the ground contour and/or engagement with an obstruction. Steps 1312, 1314, 1316, 1318.

The wing blade 1119 may move upward automatically based on presence of an upward forward force greater than a bias force provided by the compressible gas. The upward force may be provided by a trip condition, such as a force provided in response to the wing blade 1119 encountering an object. Alternatively, the upward force may be provided by a change in contour of the ground that is not seen by the primary plow 1120 (e.g., the ground contacting plane 1125 of the primary plow 1120 is substantially unchanged, but the ground near the sliding portion 1121 of the wing blade 1119 is rising). Step 1312.

If the force encountered by the wing blade 1119 does not overcome the bias force, the wing blade 1119 may remain substantially stationary. The bias force may vary as a function of the position of the wing blade 1119. Because the gas in the actuator 1145 is compressible, the bias force provided by gas may increase as the gas pressure rises in response to upward displacement of the rod of the actuator 1145. If the wing blade 1119 has encountered a force exceeding the bias force, the control system may provide hydraulic fluid to the rod side 1148 of the actuator 1145 and the pressure of the compressible gas may increase. Step 1314. As a result, the rod may retract and therefore move the sliding portion 1121 of the wing blade 1119 upward. In the illustrated embodiment, the sliding portion 1121 of the wing blade 1119 can move no farther upward than position H, which may be set by a physical configuration of the first wing 1110 (e.g., a stop or the actuator 1145). In one embodiment, the sliding portion 1121 may not move to position H in response to the upward force, and instead may move toward position H but not all the way to position H because the upward force may balance with the increasing bias force (due to compression of the gas) prior to the wing blade 1119 reaching position H.

Depending on the magnitude of upward force, the sliding portion 1121 (and consequently the wing blade 1119) may move to any position between position L and position H. If the upward force is removed or reduced, the sliding portion 1121 may move toward position A (between L and H), and hydraulic fluid on the rod side 1148 may be returned from the actuator 1145 to the hydraulic system. Step 1318. As mentioned herein, position A may correspond to a ground contact position, or position A may be above the ground such that there is a space between the wing blade 1119 and the ground.

If the control system and the wing blade 1119 has not encountered an upward force that overcomes the bias force, and the control system has received a signal from an operator has been provided to request to move the plow 1000 upward. If the control system has not received a signal requesting the wing blade 1119 move upward or downward, the control system may continue to maintain the actuator 1145 at position A, waiting for either an upward force that exceeds the bias force or an operator providing a signal to move the wing blade 1119.

If the control system has received a signal from an operator requesting to move the plow 1000, the control system may determine if the signal pertains to an upward movement request. Step 1320. If the operator has requested upward movement, the hydraulic system may push hydraulic fluid to the rod side of the lift actuator 1416. Step 1322. In response to additional hydraulic fluid on the rod side of the lift actuator 1416 and the actuator 1145, the pressure of the compressible gas may increase, while the rod retracts and the wing blade 1119 moves upward toward position H. After the actuator 1145 can retract no further, the pressure on the rod side of the lift actuator 1416 may cause the lift actuator 1416 to retract.

In the embodiment depicted in FIG. 10, an actuator 1114 is provided to operably rotate the first wing 1110 about the first axis 1101 between the F and B positions noted in conjunction with FIG. 2. The actuator 1114 may be a hydraulic actuator with its rod coupled to a bracket 1134 and its cylinder coupled to the back of a mold board 1124 of the primary plow 1120. As the rod retracts and extends, the rod actuates the bracket 1134 to rotate the first wing 1110 about the axis 1101. In the illustrated embodiment, the actuator 1114 may have hydraulic fluid on both the rod side and the cap side of the cylinder. Alternatively, the cap side of the actuator 1114 may include compressible gas operable to bias the actuator 1114 toward an extended position, but operable to allow the first wing 1110 to move toward position B in response to encountering a force that overcomes the bias force of the actuator 1114 (e.g., encountering an obstruction). Alternatively, the rod side of the actuator 1114 may include a compressible gas operable to bias the actuator 1114 toward the retracted position B, and hydraulic fluid may be supplied or removed from the cap side to position the actuator 1114 at position F or between position F and B, compressing the gas on the rod side of the actuator 1114. In this configuration, if the first wing 1110 encounters an obstruction as the vehicle is being backed up (e.g., backing up while the first wing 1110 encounters a light post), the actuator 1114 may automatically extend and allow the first wing to rotate toward position F.

It is to be understood that any of the actuators described herein with compressible gas may be positioned in this manner by supplying or removing hydraulic fluid on the side opposite of the compressible gas, or allowed to float such that the compressible gas biases the actuator to a mechanical limit of the actuator and/or the plow portion coupled to the actuator.

An operator may use the control system to rotate the first wing 1110 in accordance with the operator's directive in operation. When the control system adds hydraulic fluid to the cap side of the actuator 1114 and removes hydraulic fluid from the rod side of the actuator 1114, the rod extends and the first wing 1110 rotates about the axis 1101 away from the vehicle 10 to the requested position up to position F. When the control system adds hydraulic fluid to the rod side of the actuator 1114 and removes hydraulic fluid from the cap side of the actuator 1114, the rod retracts and the first wing 1110 rotates around the axis 1101 toward the vehicle 10 to the requested position up to position B. The extent to which the first wing 1110 can rotate in either direction around the axis 1101 may depend on the application. The second wing 1210 rotates in a similar manner but may have a different range of rotation than the first wing 1110, i.e., position F for the second wing 1210 may not correspond to position F for the first wing 1110.

In an alternative embodiment, the actuator 1114 may be operable to allow the first wing 1110 to pivot toward the vehicle 10 up to position B in response to the snow plow 1000 encountering an object that exerts a force greater than a tripping threshold or bias threshold. For example, the actuator 1114 may be configured to retract the rod in response to a force that is applied on the first wing 1110 in a direction normal or perpendicular to the first axis 1101 and that is greater than the tripping threshold. In this way, the first wing 1110 may be configured to yield in response to encountering an obstruction thus potentially limiting damage to the first wing 1110 and the snow plow 1000. While the actuator 1114 is used in this example, it is to be understood that any type of tripping mechanism may be implemented in conjunction with the first wing 1110 to facilitate yielding in response to encountering significant obstructions.

Figure 12:
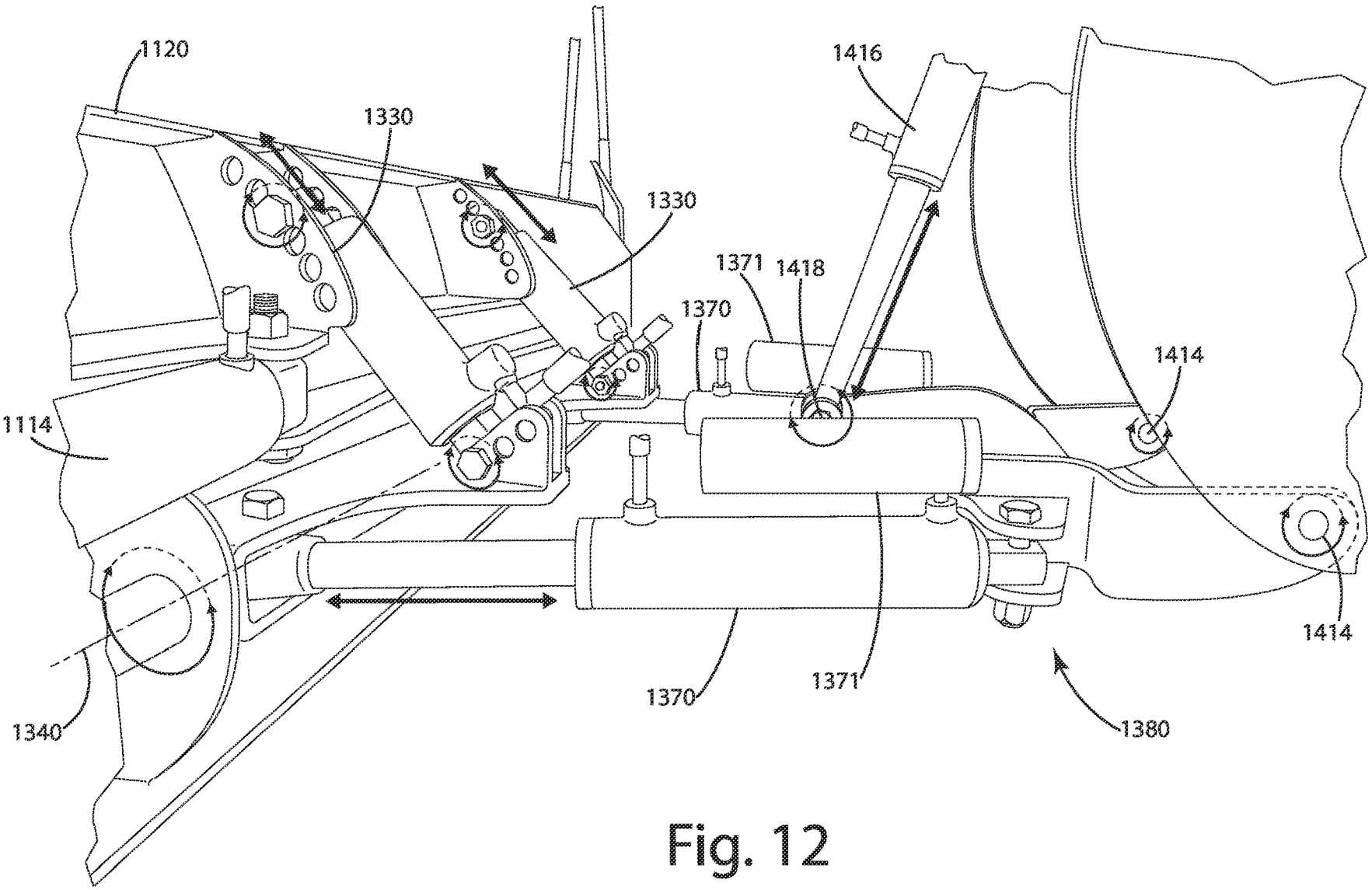
FIG. 12 shows another rear perspective view of a portion of the snow plow of FIG. 9.

In FIG. 12, another view of the rear of the snow plow 1000 of FIG. 9 is shown. FIG. 12 focuses on the primary plow 1120. In the illustrated embodiment, two actuators 1330 are shown and are connected to the rear of the primary plow 1120 on the rod side and at an angle. On the cylinder side, the actuators 1330 are attached to a plow interface 1340, about which the primary plow 1120 may pivot. The plow interface 1340 is secured to the rear of the primary plow 1120 in a pivotable manner, such that the primary plow may pivot about a longitudinal axis 1103 parallel to a forward face of the primary plow 1120 (e.g., parallel to the mold board 1124). The actuators 1330 may extend and retract to rotate the primary plow 1120 about this longitudinal axis 1103. The actuators 1330 may be coupled to the mold board 1124, as depicted in the illustrated embodiment, and can be secured to the primary plow 1120 by any suitable means, including removable pins.

In the illustrated embodiment, the actuators 1330 are hydraulic actuators with compressible gas on the rod side of the actuator 1330 and hydraulic fluid on the cap side of the actuator 1330 such that the rod is retracted and biased inward by the hydraulic fluid on the cap side. The rod side of the actuator 1330 may include an accumulator, integral or external to the actuator 1330, filled with the compressible gas. The actuators 1330 may be operable in a manner similar to the actuator 1145, with the exception of the actuator 1330 being configured to extend instead of retract in response to the lift actuator 1416 being retracted. For example, pressure on the rod side of the lift actuator 1416 may be communicated to the cap side of the actuator 1330, such that with the plow 1000 in the down position with the hydraulic fluid in float mode for the rod side of the lift actuator 1416, the compressible gas in the actuator 1333 causes the actuator 1330 to retract until a mechanical limit is reached. In response to the main blade 1126 encountering an obstruction, the actuator 1330 may extend compressing the gas.

If the primary plow 1120 encounters a tripping force (e.g., in response to the main blade 1126 of the primary plow 1120 encountering an obstruction), the compressible gas may operate in a spring-like manner, allowing the actuators 1330 to extend as the gas further compresses. If the actuators 1330 are coupled to external accumulators, gas in the rod side and the accumulator may compress and hydraulic fluid may float supplied to the cap side of the actuator 1330 such that the rod extends. As the rod extends, the primary plow 1120 rotates about a longitudinal axis 1103 such that a blade 1126 of the primary plow 1120 moves toward the vehicle 10 while the upper edge of the primary plow 1120 moves away from the vehicle 10. If the tripping force occurred because the primary plow 1120 encountered an obstruction, this tripping behavior may reduce or minimize damage to the primary plow 1120 and the snow plow 1000. After the tripping force is no longer present, the compressible gas expands in the rod side of the actuator 1130 and at least a portion of the hydraulic fluid on the cap side of the actuator 1130 may be returned to the hydraulic system, such that the rod of the actuator 1130 retracts.

The actuators 1330 can also be controlled by the control system in a manner similar to method 1300, with the exception of the actuators 1330 being biased toward a retracted position and the forces and positions pertaining to the position of the actuators 1330 instead of the actuator 1145. For instance, an operator can direct the control system to extend or retract the actuators 1330 to rotate the primary plow 1120 respectively forward or back about the longitudinal axis 1103. To rotate the primary plow 1120 forward, the control system may provide hydraulic fluid to the cap side of the actuators 1330, via supply of fluid to the fluidly coupled rod side of the lift actuator 1416) further compressing the compressible gas as the rod extends (optionally extending to its maximum length).

In one embodiment, the actuators 1330 (or any actuator described herein) may be replaced with a coupler configured similar to the actuator 1330 with the exception of being isolated from a hydraulic system. The coupler in this configuration may include compressible gas on a rod-side or a cap-side that biases the coupler respectively to a retracted position or an extended position. Extension or retraction may be mechanically limited by the coupler itself (e.g., full extension or retraction) or by a mechanical stop provided by the snow plow 1000. The coupler may extend or retract in a direction opposite the bias direction, thereby compressing the gas provided in the coupler. This extension or retraction may allow the plow 1000 to move in response to an applied force greater than the bias force provided by the compressed gas in the coupler. As an example, in the case of the actuator 1330 being a coupler that is isolated from hydraulic fluid of the hydraulic system, the coupler may be biased toward a retracted position by compressible gas. In response to the blade 1126 of the plow 1000 encountering an obstruction, the coupler may extend (compressing the gas further) and allow the plow 1000 to yield or move in response to the obstruction. After the obstruction or an applied force is no longer present, the coupler may retract to the bias position. This type of coupler may be used in place of conventional springs provided to allow a conventional plow to tilt forward in response to the plow hitting an obstruction. It is further noted that a coupler having compressible gas in accordance with one embodiment may avoid multiple of such conventional springs, with a more compact configuration and may further be adjustable by changing the pressure of the compressible gas. It is further noted that the coupler in one embodiment of the present disclosure, in contrast to a conventional extendable spring configuration for a plow, can be configured with a bias force for extension or retraction.

In the illustrated embodiments, one or more actuators (or a coupler) may include compressible gas (internal and/or external). The compressible gas may be provided to an actuator via a valve 1133, 1137 (e.g., a Schrader valve). The pressure of the compressible gas in an actuator can be varied via the valve, allowing adjustment of a bias force of the actuator.

In the illustrated embodiment of FIG. 12, the snow plow 1000 is coupled to a vehicle support 1412 in a pivotal manner relative to first and second vehicle couplings 1414. The vehicle support 1412 may be fixedly connected to the frame of the vehicle 10, which is considered conventional and not shown for purposes of disclosure. The plow support 1380 may be raised and lowered relative to the vehicle support 1412 by a lift actuator 1416, which is coupled to the plow support 1380 via lift coupling 1418. For instance, the lift actuator 1416 may be extended to lower the snow plow 1000 into contact with the ground, and the lift actuator 1416 may be retracted to raise the snow plow 1000 for transportation. As described herein, first and second actuators 1370 may extend and retract to move the snow plow 1000 proximal to and distal from the vehicle 10. In a transport mode, the first and second actuators 1370 may retract the snow plow 1000, the lift actuator 1416 may raise the snow plow 1000, and the actuator 1114 may move the wings to the B position, such that the snow plow 1000 is close to the vehicle, clears the ground, and fits within lane constraints of the road.

The first and second vehicle couplings 1414 and a coupling of the lift actuator 1416 opposite the lift coupling 1418 may be disconnected by an operator to remove the plow support 1380 and the snow plow 1000 from the vehicle support 1412.

The snow plow 1000 is described herein in conjunction with one or more actuators or couplers having compressible gas to bias the actuator or coupler toward a retracted or extended position and to allow extension or retraction in response to an applied force. It is to be understood that the snow plow 1000 is not so limited. An external spring or spring-like component may be provided in conjunction with one or more actuators or couplers to bias toward a retracted or extended position and facilitate extension or retraction in response to an applied force. For instance, a compressible spring may be provided in conjunction with the actuator 1370 to bias the actuator 1370 and the plow toward the 0 position. In response to the plow encountering an obstruction or a force applied toward position I, the compressible spring may enable the plow and the actuator 1370 to retract.

Figure 14:
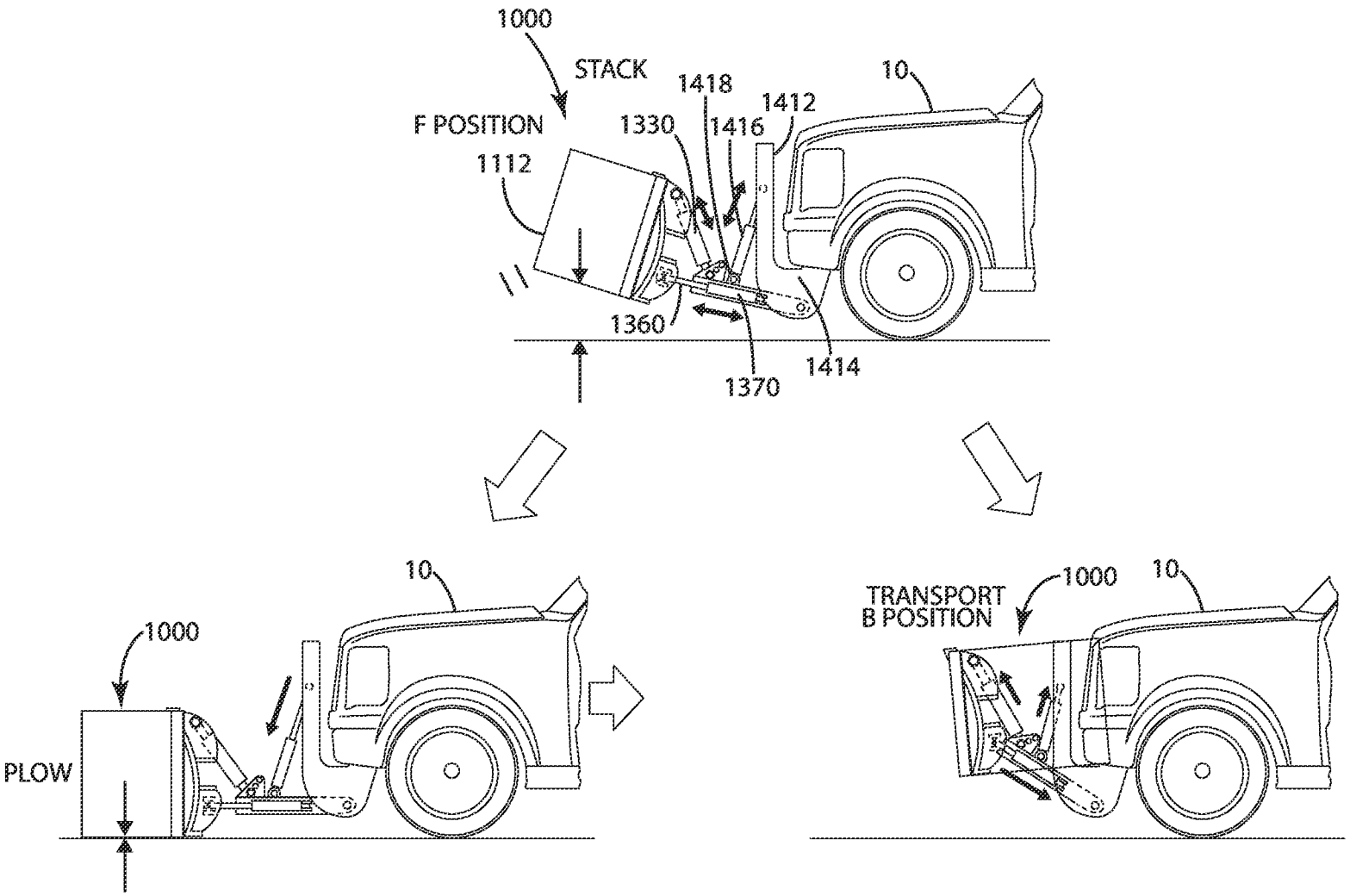
FIG. 14 shows various modes of operation in accordance with one embodiment.

In the illustrated embodiments of FIGS. 12 and 14, the snow plow 1000 and the blade 1126 may be lifted off the ground by retraction of the lift actuator 1416. The angle of the snow plow 1000 relative to the longitudinal axis 1103 may be varied by the actuators 1330. With this arrangement, the forward position and height of the snow plow 1000 and blade 1126 can be controlled while also maintaining an angle of the snow plow 1000 relative to the longitudinal axis 1340. In the illustrated embodiment, in response to lifting the plow 1000 to a raised position, the actuators 1330 may extend due to pressure in the hydraulic system and tilt the snow plow forward in a raised position.

In an alternative embodiment, the angle of the snow plow 1000 may be controlled separately from the position of the lift actuator 1416. For instance, the angle of the snow plow 1000 may be kept in a generally vertical manner by extending or retracting the actuators 1330 based on the forward position and height of the snow plow 1000 determined by the lift actuator 1416 and the first and second actuators 1370.

By controlling the angle of the snow plow 1000 in conjunction with the height and forward position, the snow plow 1000 can be maneuvered to comply with road width limitations, avoid contact between the wings 1112, 1212 and the ground (particularly the tips of the wings 1112, 1212 as depicted in FIG. 14). Additionally, the snow plow 1000 can be transitioned among various modes of operation, including a plow mode with the snow plow 1000 in contact with the ground, a stacking mode in which the snow plow 1000 is raised for pushing and stacking snow above the ground, and a transportation mode in which the snow plow 1000 is stowed for travel. In these various modes, despite changes in height and forward position of the snow plow 1000 relative to the vehicle, the angle of the snow plow 1000 may be adapted to be generally vertical (or another angle in accordance with operator directive).

To rotate the primary plow 1120 backward, the control system may remove hydraulic fluid or remove pressure from the cap side of the actuator 1330 so that the compressible gas can further retract the rod. Depending on the height of the primary plow 1120 and the first and second wings 1112, 1212, and the position of the first or second wings 1112, 1212 relative to the B and F positions, the primary plow 1120 may be limited in rotating backward around the longitudinal axis 1103 because the first wing 1110 and the second wing 1210 may come into contact with the ground. Contact in this manner may cause wear or damage to the wing blades 1119, 1219. The angle of the primary plow 1120 and/or the height of the wing blades 1119, 1219 may be adjusted as the height of the primary plow 1120 is varied by retraction of the lift actuator 1416, as shown for example in the transition to the plow mode depicted in FIG. 14. The positions of the actuators shown in FIG. 14 for the various modes of operation may or may not correspond to the maximum retraction or extension of the actuators, depending on the application.

The position of the snow plow 1000 may be obstructed from the driver's view by portions of the vehicle 10. For instance, from his or her position in the cabin of the vehicle 10, the driver may be unable to see the position of the snow plow 1000 over the hood of the vehicle 10. To facilitate visibility, the snow plow 1000 may include one or more visibility markers 1020. The visibility markers 1020 may be attached to the outer edges of the primary plow 1120, the first wing 1110, and the second wing 1210. The visibility markers 1020 allow a driver of the vehicle 10 to more easily see the position of the snow plow 1000.

In the illustrated embodiment, the vehicle support 1412 is mounted to the frame of a vehicle 10. The snow plow 1000 may be releasably coupled to the vehicle support 1412. The snow plow 1000 can be retrofitted for a range of mounting configurations for the vehicle 10 and is not limited to the vehicle support 1412.

Figure 13:
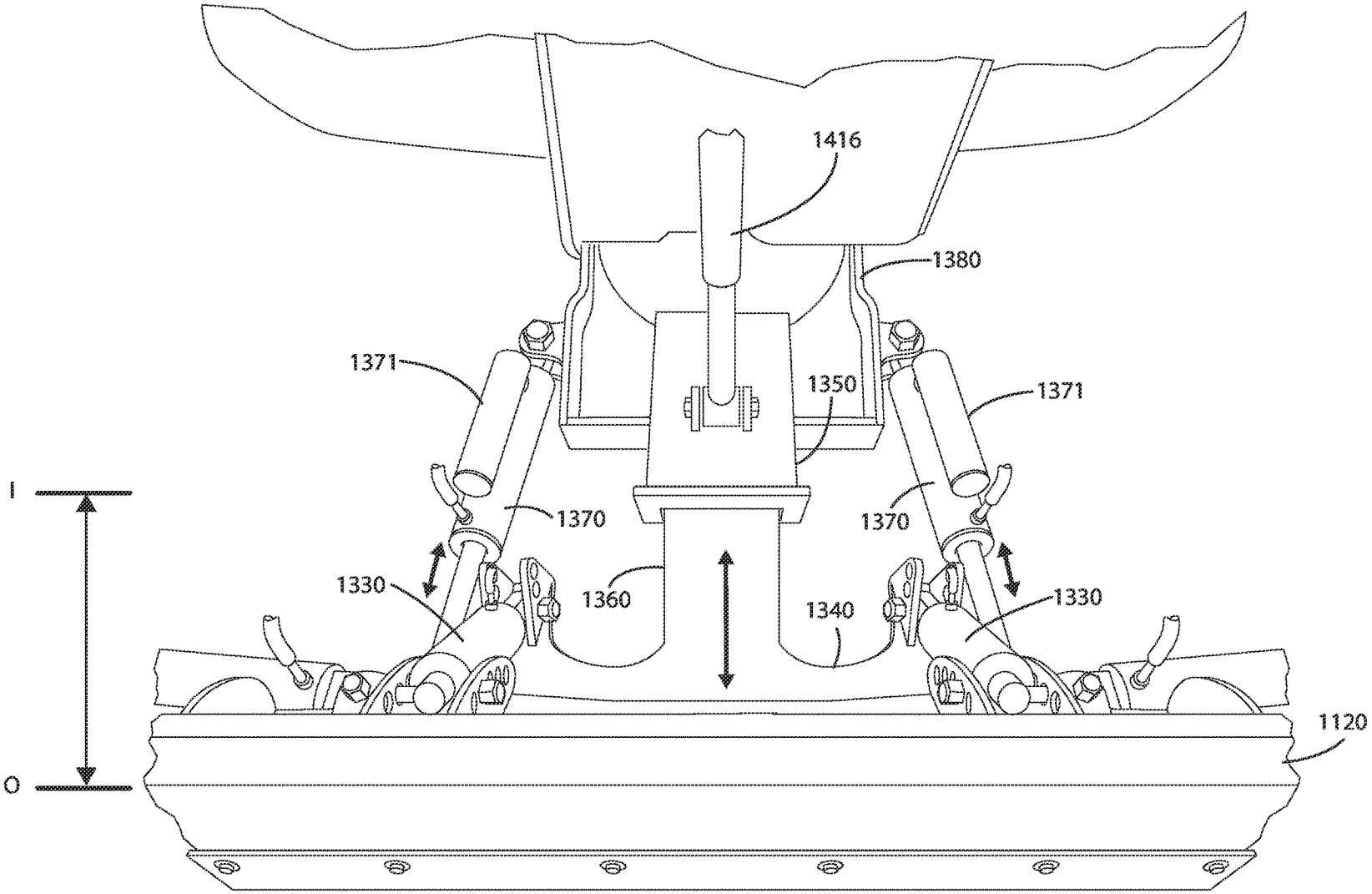
FIG. 13 shows a top view of a system for moving a snow plow proximally and distally with respect to a vehicle in accordance with one embodiment.

In one embodiment, the plow support 1380 of the snow plow 1000 comprises a receiver 1350, which may be configured to support a receiver interface 1360. The plow support 1380 may removably attach to the vehicle support 1412. The receiver 1350 of the plow support 1380 and the receiver interface 1360 may allow the snow plow 1000 to move proximally and distally relative to the vehicle 10. As shown in FIG. 13, the receiver 1350 is coupled to the plow support 1380, and the plow support 1380 is attached to the vehicle support 1412. Alternatively, the receiver 1350 may be coupled directly to the vehicle support 1412. In the depicted embodiment, the receiver 1350 defines an opening configured to receive a receiver interface 1360 and the receiver interface 1360 is movably coupled to the receiver 1350. For example, the receiver interface 1360 may be a protrusion or a shank. As depicted, the receiver interface 1360 forms part of the plow interface 1340 and extends from the rear surface of the primary plow 1120. In an alternative embodiment, the receiver interface 1360 may be a separate component from the plow interface 1340 and may not be coupled to the plow interface 1340. In another alternative embodiment, the receiver interface 1360 may be a separate component from the plow interface 1340 but may be coupled to the plow interface 1340. In one embodiment, the receiver 1350 and the receiver interface 1360 are operable to restrict movement in directions perpendicular to a longitudinal axis of the receiver 1350 such that movement is substantially prevented in directions perpendicular to the longitudinal axis.

The receiver 1350 may be coupled to at least one actuator 1370 via the plow interface 1340. The actuators 1370 may be coupled to the plow support 1380 on the cylinder side and to the plow interface 1340 on the rod side. In an alternative embodiment, the actuators 1370 may be directly coupled to the receiver 1350 on the cylinder side, directly coupled to the mold board 1124 on the rod side, or both. As depicted, the actuators 1370 are hydraulic actuators with hydraulic fluid on both the rod side and compressed gas on the cap side of the cylinder. The actuators 1370 may be biased in the extended position via compressed gas on the cylinder side of the actuators 1370, and operative to retract in response to a force greater than the bias force of the actuators 1370 (e.g., in response to the snow plow 1000 encountering an obstruction.) The actuators 1370 may be controlled by providing hydraulic fluid under pressure to the rod side of the actuators 1370 to retract the actuators 1370. If pressure is removed from the rod side of the actuators 1370, the actuators 1370 may extend until mechanically limited based on expansion of the compressible gas.

In an alternative embodiment, the receiver 1350 may attach to the primary plow 1120 and the receiver interface 1360 may attach to the plow support 1380. The actuator 1370 may be mounted with the rod side attached to the plow interface 1340 (as shown) or the plow support 1380.

An operator can control the distance between the snow plow 1000 and the vehicle 10 by directing the control system to move the snow plow 1000 between position O and position I. In response to receiving a command from an operator to move the snow plow 1000 toward position I, the control system may supply hydraulic fluid to the rod side of the actuator 1370, further compressing compressible gas on the cylinder side of the actuator 1370. In the illustrated embodiment, the actuators 1370 include external accumulators 1371 coupled to the cylinder side and capable of storing compressible gas in conjunction with the cylinder side of the actuators 1370. The external accumulator 1371 may facilitate greater length of travel for the actuator 1370 relative to a configuration without the external accumulator 1371, providing gas of sufficient pressure throughout the range of motion of the actuator 1370 and sufficient bias force to retract in response to an obstruction but not in response to pushing snow or debris. In an alternative embodiment, the actuators 1370 may not include compressible gas on the cylinder side, and may be actuated by hydraulic fluid in a push-pull coordinated manner on the cylinder side and rod side.

Movement toward position I causes the receiver interface 1360 to slide further into the receiver 1350. Position I is the closest the snow plow 1000 can be moved to the vehicle 10 proximally, and may vary from application to application depending on the construction. Position I may be the position of the snow plow 1000 when the rods of the actuators 1370 are fully retracted. Alternatively, or additionally, position I may be the position of the snow plow 1000 when the receiver interface 1360 is fully seated in the receiver 1350. In another embodiment, position I may be the position of the snow plow 1000 when the receiver interface 1360 contacts a back edge of the receiver 1350, which may or may not be the point at which the receiver interface 1360 is fully covered by the receiver 1350.

If the control system receives a command from an operator to move the snow plow 1000 toward position O, the control system may withdraw hydraulic fluid to the rod side of the actuator 1370. This causes the rods to extend and the receiver interface 1360 to slide out of the receiver 1350. Position O may correspond to the farthest the snow plow 1000 can be disposed from the vehicle 10 distally. In one embodiment, position O is reached when the rods of the actuators 1370 are fully extended. In one embodiment, the rods are 14" long. Additionally, or alternatively, position O may be the position of the snow plow 1000 when the end of the receiver interface 1360 reaches the end of the receiver 1350. In one embodiment, position O is selected to substantially prevent overextension of the actuators 1330. For example, if the cylinder side of the actuators 1330 is coupled to the plow support 1380 rather than the plow interface 1340, position O may be selected to be more proximal to the vehicle 10 in order to prevent overextension of the actuators 1330.

As described herein, the actuators 1370 may have compressible gas on the cap side of the cylinder and hydraulic fluid on the rod side of the cylinder such that the rod is biased in the extended position. Thus, the primary plow 1120 is biased at position O. When the primary plow 1120 comes into contact with a force above a tripping threshold or overcomes a bias force of the actuators 1370, the actuators 1370 may operate in a spring-like manner, and hydraulic fluid is provided to the rod side of the cylinder and the compressible gas compresses further in the cylinder side and the external accumulator 1371 such that the rod of each actuator 1370 retracts and moves the primary plow toward position I. The primary plow 1120 may move all the way to position I or may move to some position between position O and position I depending on the strength of the obstruction force. This allows the primary plow 1120 to yield when encountering an obstruction which may prevent or reduce damage to the snow plow 1000. When the obstruction force is no longer present, hydraulic fluid may be withdrawn from the rod side of the actuator 1370 (e.g., automatically in response to pressure from the gas) and the compressible gas may expand such that the actuators 1370 are once again biased toward the extended position and the primary plow 1120 returns to position O or a position between O and I at which the operator has selected for operation.

If the vehicle 10 with the snow plow 1000 is travelling from place to place, it can be configured in a transport mode as depicted in the illustrated embodiment of FIG. 14. The snow plow 1000 can be in a variety of positions during transport mode. For example, the primary plow 1120 may be tilted forward about the longitudinal axis 1103 and the first wing 1110 and the second wing 1210 may be rotated around the axes 1101, 1201 back toward the vehicle 10. This lifts the blade 1126 off the ground and keeps it behind the primary plow 1120 while driving such that the blade 1126 is not the first point of contact if the snow plow 1000 comes into contact with an obstruction. The control system may move the snow plow 1000 to this position by adjusting the length of the lift actuator 1416, the actuators 1330, the actuators 1370, and the actuators 1114, 1214. To tilt the primary plow 1120 forward, the control system supplies hydraulic fluid to the cap side of the actuators 1330 further compressing the compressible gas. This causes the rods of the actuators 1330 to extend, pushing the top edge of the primary plow 1120 forward and consequently tilting the blade 1126 toward the vehicle 10. To move the first wing 1110 and the second wing 1210 backwards, the control system removes hydraulic fluid from the cap side of the actuators 1114, 1214 and supplies hydraulic fluid to the rod side of the cylinders of the actuators 1114, 1214, which causes the rods to retract. As the rods retract, the first wing 1110 is rotated about the axis 1101 toward the vehicle 10 and the second wing 1210 is rotated about the axis 1201 toward the vehicle 10. As the primary plow 1120 tilts forward, the outer edge of the first wing 1110 and the second wing 1210 and the wing blades 1119, 1219 lift off the ground and rotate toward the vehicle 10. This may provide a safer transport mode because all blades are rotated back toward the vehicle 10.

There are applications where controlling the distance of the snow plow 1000 relative to the vehicle 10 is useful. For example, when parking the vehicle 10, an operator may want to move the snow plow 1000 closer to the vehicle 10 in order to allow the vehicle 10 to better fit into a parking space. An operator may want the snow plow 1000 to be further away from the vehicle 10 when plowing in order to minimize blowback of the snow onto the vehicle 10 or to provide less clearance between the snow plow 1000 and the vehicle 10 when the snow plow 1000 is actuated to its transport mode. The closer the snow plow 1000 is to the vehicle 10 during transport, the closer the center of gravity of the vehicle 10 and the snow plow 1000 is to vehicle's center of gravity without the plow 1000, and the more even the weight of the system is distributed the wheels.

Although a moveable portion (e.g., a wing blade 1119) is described in conjunction with a wing 1110 relative to a primary plow 1120, it is to be understood that the present disclosure is not so limited. The plow 1000 may include any number of segments, such as two segments that form the primary plow 1120 capable of forming a V-configuration (e.g., a V plow). As another example, the plow 1000 may include four segments, including two segments that form a V-configuration and two wings respectively coupled to one of the two segments that form the V-configuration. Any segment of the plow 1000 may include a movable portion configured according to one or more embodiments described herein. For instance, a V-plow may include wing blades 1119 capable of rotating upward and downward relative to a pivot point to follow the ground contour and/or move in response to encountering an obstruction. In another example, with a four segment plow, each segment may include a rotatable or movable portion capable of following the ground.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiment of the invention in which an exclusive property or privilege is claimed are defined as follows:

1. A snow plow comprising:

a plow portion having first and second sides opposite each other with a blade disposed between the first and second sides, the blade operable to contact a ground surface to facilitate moving snow; and a first wing that is rotatably coupled to the first side of the plow portion via a first connection, the first wing being configured to rotate about a first axis substantially parallel to the first side of the plow portion, the first wing including a main wing portion operable to rotate about a second axis that is non-parallel to the first axis, whereby the main wing portion is operable to rotate upward about the second axis relative to the ground surface in response to the first wing encountering an upward force.

2. The snow plow of claim 1 comprising a second wing that is rotatably coupled to the second side of the plow portion via a second connection, the second wing being configured to rotate about a second wing first axis substantially parallel to the second side of the plow portion, the second wing including a second wing main portion operable to rotate about a second wing second axis that is non-parallel to the first axis, whereby the second wing main portion is operable to rotate upward about the second wing second axis relative to the ground surface in response to the second wing encountering an upward force.

3. The snow plow of claim 1 wherein the second axis is substantially perpendicular to the first axis.

4. The snow plow of claim 1 wherein the first wing includes a secondary portion operably coupled to the first side of the plow portion via the first connection, the secondary portion being connected to the main wing portion via a lower connector and an upper connector.

5. The snow plow of claim 1 wherein the first wing includes a secondary portion operably coupled to the first side of the plow portion via the first connection, the secondary portion being connected to the main wing portion via a pivotable connection.

6. The snow plow of claim 5 wherein the pivotable connection defines the second axis of rotation such that the main wing portion is operable to rotate at the pivotable connection about the second axis.

7. The snow plow of claim 5 wherein a medial side of the main wing portion is connected to the secondary portion via the pivotable connection, wherein a lateral side of the main wing portion is connected to an actuator, and wherein the lateral side is movable relative to the secondary portion via the actuator.

8. The snow plow of claim 7 wherein the actuator is configured to raise and lower the lateral side of the main wing portion.

9. The snow plow of claim 7 wherein the actuator is operable to automatically retract in response to application of force on the main wing portion in a direction perpendicular to the second axis.

10. The snow plow of claim 5 wherein the main wing portion is a blade portion of the first wing that contacts the ground surface.

11. The snow plow of claim 1 wherein the snow plow includes a plow-side mount operable to removably connect to a vehicle-side mount.

12. A snow plow comprising:

a plow portion having a first side and a second side opposite each other with a blade disposed between the first and second sides, the blade operable to contact a ground surface to facilitate moving snow; and a first wing that is rotatably coupled to the first side of the plow portion via a first connection, the first wing being configured to rotate about a first axis substantially parallel to the first side of the plow portion, the first wing including a first wing blade operable to rotate about a second axis that is non-parallel to the first axis, whereby the first wing blade is operable to rotate upward about the second axis relative to the ground surface in response to the first wing blade encountering an obstruction.

13. The snow plow of claim 12 comprising a second wing that is rotatably coupled to the second side of the plow portion via a second connection, the second wing being configured to rotate about a second wing first axis substantially parallel to the second side of the plow portion, the second wing including a second wing blade operable to rotate about a second wing second axis that is non-parallel to the second wing first axis, whereby the second wing blade is operable to rotate upward about the second wing second axis relative to the ground surface.

14. The snow plow of claim 12 wherein the second axis is substantially perpendicular to the first axis.

15. The snow plow of claim 12 wherein the first wing includes a hydraulic actuator, wherein the hydraulic actuator is coupled to the first wing blade, wherein the hydraulic actuator is operable to move the first wing blade such that the first wing blade rotates upward and downward about the second axis in response to respective retraction and extension of the hydraulic actuator.

16. The snow plow of claim 15 wherein a rod of the hydraulic actuator is coupled to the first wing blade.

17. The snow plow of claim 15 wherein the hydraulic actuator is operable to enable the first wing blade to move upward.

18. The snow plow of claim 15 wherein the hydraulic actuator is operable to rotate the first wing blade in response to a control command by an operator.

19. The snow plow of claim 15 wherein the hydraulic actuator has hydraulic fluid on a rod side of a cylinder and nitrogen gas on a cap side of the cylinder such that the hydraulic actuator is biased to an extended position, whereby the extended position corresponds to a downward position of the first wing blade.

20. The snow plow of claim 12 wherein the plow portion includes at least one hydraulic actuator operable to rotate the plow portion about a longitudinal axis in response to the blade encountering an obstruction.

* * * * *